US011033462B2

(12) United States Patent
Geels et al.

(10) Patent No.: US 11,033,462 B2
(45) Date of Patent: Jun. 15, 2021

(54) INFANT FEEDING ASSEMBLY

(71) Applicant: Hero AG, Lenzburg (CH)

(72) Inventors: Abke Geels, Den Hoorn (NL); Erich Altorf, The Hague (NL); Witte Van Cappellen, Åkersberga (SE); Ronald Michiel Lewerissa, Delft (NL)

(73) Assignee: Hero AG, Lenzburg (CH)

( * ) Notice: Subject to any disclaimer, the term of this patent is extended or adjusted under 35 U.S.C. 154(b) by 88 days.

(21) Appl. No.: 15/526,739

(22) PCT Filed: Nov. 13, 2015

(86) PCT No.: PCT/EP2015/076523
§ 371 (c)(1),
(2) Date: May 12, 2017

(87) PCT Pub. No.: WO2016/075275
PCT Pub. Date: May 19, 2016

(65) Prior Publication Data

US 2018/0207064 A1 Jul. 26, 2018

(51) Int. Cl.
*A61J 11/00* (2006.01)
*A61J 9/04* (2006.01)
(Continued)

(52) U.S. Cl.
CPC ..... *A61J 11/004* (2013.01); *A61J 9/00* (2013.01); *A61J 9/04* (2013.01); *A61J 11/0045* (2013.01); *A61J 11/04* (2013.01); *A61J 1/2093* (2013.01)

(58) Field of Classification Search
CPC ..... A61J 11/004; A61J 9/00; A61J 9/04; A61J 11/0045; A61J 11/04; A61J 1/2093
See application file for complete search history.

(56) References Cited

U.S. PATENT DOCUMENTS 1,280,942 A * 10/1918 Apple ..... B65D 47/248
215/11.1
2,330,019 A * 9/1943 Vaughn ..... A61J 9/00
215/11.1
(Continued)

FOREIGN PATENT DOCUMENTS

| | | |
|---|---|---|
| CN | 1184113 C | 1/2005 |
| CN | 102670411 A | 9/2012 |
| WO | 03/051744 A1 | 6/2003 |

OTHER PUBLICATIONS

International Search Report and Written Opinion for International Patent Application No. PCT/EP2015/076523 dated Jan. 18, 2016.
(Continued)

*Primary Examiner* — Tri M Mai
(74) *Attorney, Agent, or Firm* — Troutman Pepper Hamilton Sanders LLP; Ryan A. Schneider

(57) ABSTRACT

The invention relates to an infant feeding assembly comprising a feeding bottle and a sealed cup holding a single serve of infant formula to be mixed with water. The bottle comprises a cup holder, a teat, a mounting ring, a water fill opening and a closure device. The cup holder is adapted to hold the cup, in an opened condition. The teat has a dome shaped base and a spout. The mounting ring releasably mounts the teat onto the cup holder. According to the invention, the water fill opening, through which a mixing cavity of the feeding bottle can be filled with water while the opened cup is held by the cup holder and the teat is mounted on the cup holder, is provided in the cup holder and/or in the mounting ring and/or in the teat. The cup and the teat at least partially define the mixing cavity.

16 Claims, 8 Drawing Sheets

(51) Int. Cl.

| | |
|---|---|
| ***A61J 11/04*** | (2006.01) |
| ***A61J 9/00*** | (2006.01) |
| ***A61J 1/20*** | (2006.01) |

(56) References Cited

U.S. PATENT DOCUMENTS

| | | | | | |
|---|---|---|---|---|---|
| 2,372,281 | A * | 3/1945 | Jordan | A61J 9/04 | 215/11.1 |
| 2,628,913 | A * | 2/1953 | Horan | A61J 9/00 | 215/11.3 |
| 2,876,113 | A * | 3/1959 | Barton | A61J 9/001 | 426/117 |
| 3,163,544 | A * | 12/1964 | Valyi | B65D 25/02 | 426/112 |
| 3,777,925 | A * | 12/1973 | Eckholm | A61J 9/001 | 215/11.3 |
| 3,784,039 | A * | 1/1974 | Marco | A61J 9/001 | 215/11.3 |
| 4,821,895 | A * | 4/1989 | Roskilly | A61J 7/0046 | 215/11.1 |
| 5,361,918 | A * | 11/1994 | Mason | A61J 1/20 | 215/11.1 |
| 6,253,935 | B1 * | 7/2001 | Fletcher | A61J 11/045 | 215/11.1 |
| 6,257,429 | B1 * | 7/2001 | Kong | A61J 9/001 | 215/11.3 |
| 6,520,070 | B1 * | 2/2003 | Heczko | A23L 2/00 | 426/113 |
| 6,616,000 | B1 | 9/2003 | Renz | | |
| 6,733,669 | B1 * | 5/2004 | Crick | C02F 1/003 | 210/244 |
| 6,737,091 | B1 * | 5/2004 | Littell, II | A61J 9/001 | 215/11.1 |
| 6,910,594 | B2 * | 6/2005 | Foley | A61J 9/001 | 215/11.1 |
| 7,506,754 | B2 * | 3/2009 | Segovia, Jr. | A61J 1/2093 | 206/219 |
| 7,896,181 | B1 | 3/2011 | Francis et al. | | |
| 7,909,187 | B2 * | 3/2011 | Montgomery | A61J 9/001 | 215/11.1 |
| 8,376,003 | B2 * | 2/2013 | Py | A61J 1/1406 | 141/330 |
| 8,579,130 | B2 | 11/2013 | Brown et al. | | |
| 8,709,518 | B2 * | 4/2014 | Young Jones | A61J 11/002 | 116/308 |
| 8,720,712 | B1 | 5/2014 | Faber | | |
| 10,028,890 | B2 | 7/2018 | Rhodes et al. | | |
| 2006/0078656 | A1 * | 4/2006 | Manning | A61J 9/001 | 426/117 |
| 2008/0217282 | A1 * | 9/2008 | Brown | A61J 9/006 | 215/11.5 |
| 2009/0039050 | A1 * | 2/2009 | Rea | A61J 9/00 | 215/11.6 |
| 2012/0318766 | A1 | 12/2012 | Questad et al. | | |
| 2013/0224344 | A1 * | 8/2013 | Mathieu | A47J 31/40 | 426/115 |

OTHER PUBLICATIONS

Search Report for priority Dutch Patent Application No. 2013794 completed on Jul. 3, 2015.

The First Office Action From the State Intellectual Property Office of the People's Republic of China for CN Application No. 201580061863.2, dated Oct. 9, 2019.

* cited by examiner

Fig.7a
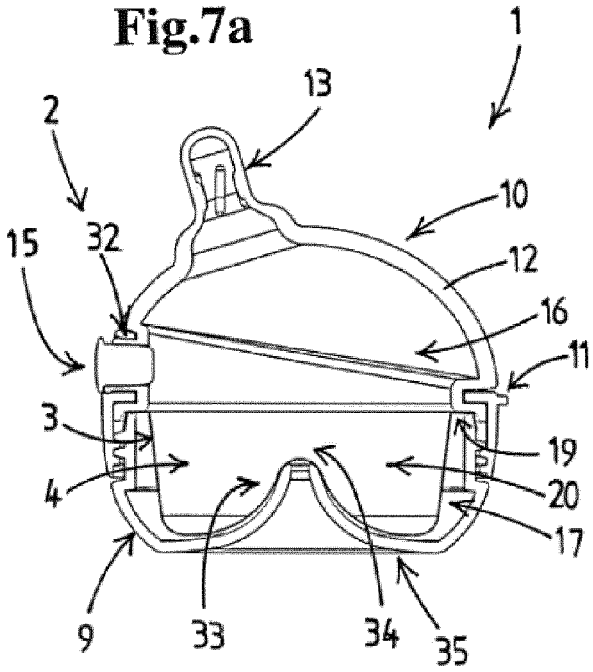
Fig.7b
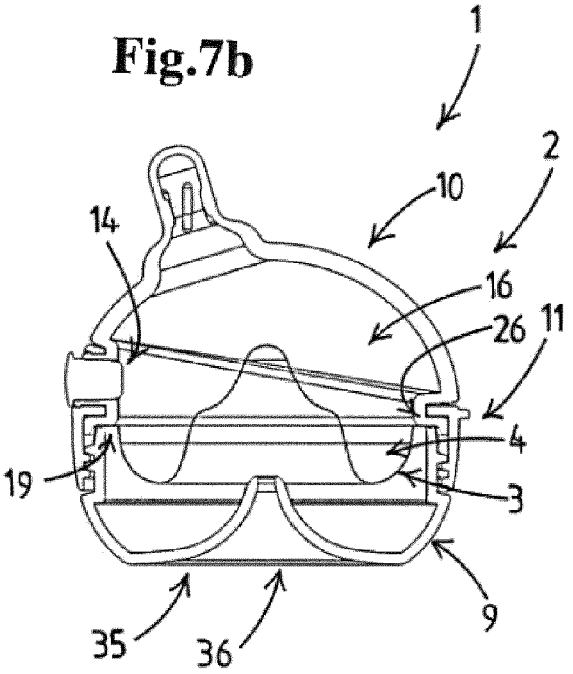
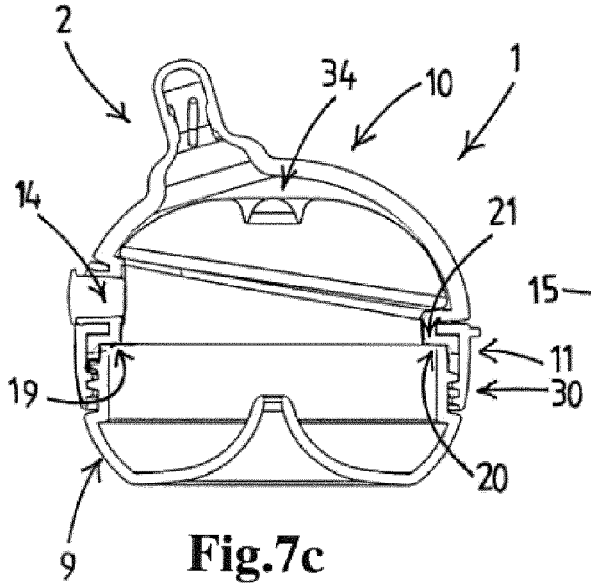
Fig.7c
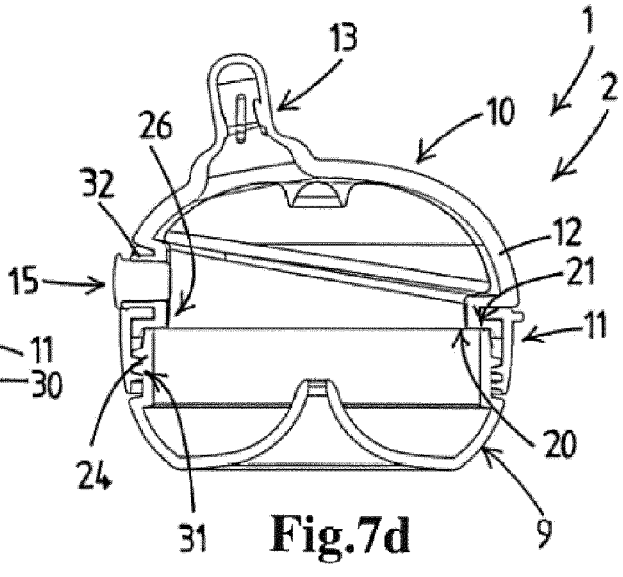
Fig.7d

INFANT FEEDING ASSEMBLY

FIELD AND BACKGROUND OF THE INVENTION

This invention relates to an alternative infant feeding assembly, a feeding bottle cup for such a feeding assembly, a sealed cup for such a feeding assembly and a method for using such an assembly for feeding an infant.

The present invention proposes to provide a feeding assembly, the feeding assembly comprising a sealed cup filled with a single serve of infant formula and a feeding bottle configured for use with such a cup. According to the invention to prepare the feeding bottle for feeding an infant the cup with infant formula is to be positioned in the feeding bottle, with the seal of the cup at least partially removed from the cup, and the infant formula is to be mixed with water inside the feeding bottle. During use of the feeding bottle, the cup forms a functional part of the feeding bottle, i.e. partially defines a mixing chamber of the feeding bottle for holding the infant formula mixed with water.

Known feeding bottles are often multiple use feeding bottles, the feeding bottles comprising a bottle section for holding the infant formula mixed with water, and a teat that is to be mounted on said bottle section after it has been filled with the infant formula and water. Since the bottle section and the teat are reused, they need to be sterilized prior to use, i.e. each time when the feeding bottle is prepared for feeding an infant. Infant formula is typically obtained from large volume packages, i.e. a package holding an amount of infant formula sufficient for providing multiple serves. When preparing such a feeding bottle for feeding an infant, the user has to meter the correct amount of infant formula from the large volume package, and then transfer the metered amount of infant formula to the bottle section. The teat is mounted on the bottle section after the infant formula has been mixed with water.

It is also known to provide single use feeding bottles. These feeding bottles are provided comprising a single serve of infant formula, which is to be mixed or has already been mixed with water. After use, the bottles are discarded, not to be used again for feeding an infant. This type of feeding bottles is made of low cost materials, often thin flexible materials, which do not provide a firm grip during use for the person feeding the infant.

The invention aims to provide an alternative infant feeding assembly, which feeding assembly reduces the chance of contamination of the infant formula during the preparation of the feeding bottle, and which feeding assembly preferably provides an easy to use feeding bottle.

According to yet a further aspect, the invention intents to provide an ergonomically shaped feeding bottle that can be held in the palm of the hand, and which feeding bottle mimics a breast to thus enable a user to closely imitate the natural feeding process when feeding an infant using the feeding bottle.

SUMMARY OF THE INVENTION

The invention provides an infant feeding assembly according to claim 1.

An infant feeding assembly according to the invention comprises a feeding bottle and a sealed cup, the cup having a sealed cavity holding a single serve of infant formula to be mixed with water, The feeding bottle comprises:

- a cup holder, adapted to hold the cup, in an opened condition, i.e. with its seal at least partially removed;
- a teat, the teat having a dome shaped base and a spout on that base, the teat mimicking a breast;
- a mounting ring, which mounting ring releasable mounts the teat onto the cup holder;
- a water fill opening, which water fill opening is provided in the holder and/or in the mounting ring and/or in the base of the teat, through which water fill opening a mixing cavity of the feeding bottle can be filled with water while the opened cup is held by the cup holder and the teat is mounted on the cup holder, the cup and the teat at least partially defining the mixing cavity,
- a closure device adapted to seal said water fill opening to allow for mixing, in the mixing cavity at least partially defined by the teat and the cup, the infant formula with the water, by shaking the feeding bottle.

The invention thus provides a multiple use feeding bottle in combination with a single use component in the form of a cup, which cup holds a sealed single serve of infant formula to be mixed with water. When the feeding bottle is used for feeding an infant, the cup, with its seal at least partially removed, is located in the feeding bottle and forms a functional part of the feeding bottle, i.e. together with the teat at least partially defines a mixing cavity for holding the infant formula mixed with water. The feeding bottle is provided with a water fill opening through which the mixing cavity of the feeding bottle can be filled with water while the opened cup is held inside the feeding bottle and the teat is mounted on the cup holder. Thus, the feeding bottle can be assembled, i.e. the teat can be mounted on the cup holder prior to mixing the infant formula with water inside the feeding bottle.

Since the cup is provided with a single serve of infant formula, there is no need for the person preparing the bottle to meter the correct amount of infant formula prior to the mixing. Furthermore, because the cup is positioned inside the feeding bottle there is no need for transferring the infant formula from a large volume package, i.e. a package holding multiple serves of infant formula, into the feeding bottle. Thus, the chance of spillage and contamination of the infant formula during the preparation of the feeding bottle is reduced. Providing a sealed cup that holds only a single serve of infant formula furthermore allows for removing the seal only when the infant formula is to be used. This in contrast with packaging holding multiple serves of infant formula, which are to be opened each time a feeding bottle is to be prepared. It is noted that once a package has been opened a user can never close it again under the same clean conditions as when the package was filled and sealed in the factory. Providing a sealed single serve cup thus reduces the chance that the infant formula gets contaminated prior to use. The seal furthermore keeps in the inside of the cup free from contamination, such that the inside of the cup can be used in the feeding bottle, i.e. can define part of a mixing chamber of the feeding bottle for holding the infant formula mixed with water, without the need of the cup to be sterilized by the user preparing the feeding bottle.

The invention thus provides an alternative infant feeding assembly, which feeding assembly reduces the chance on contamination of the infant formula during the preparation of the feeding bottle.

According to the invention, the cup is a disposable single use package comprising a cavity holding the infant formula, which cavity is sealed with a seal that is to be at least partially removed prior to use. Thus, the contents of the cup, i.e. the single serve of infant formula to be mixed with water, can be kept under sterilized conditions up to use, and the inside of the cup can be kept under sterilized conditions up to use.

Furthermore, with a feeding assembly according to the invention, the feeding bottle in its assembled state, i.e. with the teat mounted on the cup holder holding the cup in its opened state, has a mixing cavity for holding the infant formula and the water that is to be mixed with the infant formula, which mixing cavity can be filled with water using the water fill opening. The invention thus enables a feeding bottle with a mixing cavity of which the main part is defined by the cup and the teat, or which is even fully defined by the cup and the teat. With such an embodiment, the part of the cup that defines the mixing cavity is kept under sterilized conditions up to use, i.e. up to when the seal is removed. Thus, only the teat needs to be sterilized when preparing the feeding bottle for feeding an infant. The invention thus provides a feeding assembly which is easy to use, more in particular a feeding bottle which is easy to prepare for feeding an infant.

Furthermore, the invention thus provides a feeding bottle that utilizes the inner volume of the teat for providing the mixing cavity with a volume for holding the water to be mixed with the infant formula, and therefore allows for providing a sealed cup with a volume not much larger than required for holding the single serve infant formula. Thus, the cups to be used with the feeding bottle can be kept small, which is economical with respect to manufacturing, transporting and storing the cups. In an embodiment the teat engages the flange of the cup when the feeding bottle in its assembled state and the mixing cavity, for holding the infant formula and the water that is to be mixed with the infant formula, is defined by only the cup, the cup forming the bottom end of the mixing cavity, and the teat, the teat forming the top end of the mixing cavity.

Prior to use, the seal protects the infant formula held in the cup against contamination from the outside environment. In an embodiment, the seal is fixed to the cup such that when it is torn from the cup, the seal is fully removed from the cup. In such an embodiment, there are no parts of the seal left on the cup when the cup has been positioned in the feeding bottle in its opened state.

In an alternative embodiment, when the seal is torn from the cup a section of the seal stays behind on the flange of the cup, i.e. on the seal attachment surface or foil sealing surface of flange of the cup. For example an outer ring section of the seal may remain on the outer periphery of the flange of the cup. In such an embodiment, the feeding bottle is configured such that when the cup is secured in the cup holder, preferably by the teat mounted on the cup holder, the parts of the seal that remain on the flange of the cup are covered or shielded such that they are not in the present in the mixing room in which the infant formula is mixed with water. For example, the cup can be secured in the cup holder by the mounting ring and/or a flange of the teat engaging the flange of the cup and clamping it onto the support surface of the cup holder. In such an embodiment, the clamping ring and/or the flange of the teat are dimensioned such that they cover at least that part of the flange of the cup where parts of the seal may still be present. Thus, only those parts of the cup, and possibly those parts of the seal, that were shielded from the outside environment, prior to the seal being partially removed, can come into contact with the infant formula and the water it is to be mixed with.

In another embodiment, the seal is a layered seal, and is configured such that at least a top layer is removed from the part of the seal that is to be attached to the flange of the cup. Thus, in case parts of the seal remain on the flange of the cup, i.e. on the seal attachment surface of flange of the cup, those parts have not been in contact with the outside environment prior to the seal being removed, and can thus not be contaminated. If such a part of the seal would contact the infant formula and/or the water to be mixed with the infant formula, the risk of contamination would thus be extremely low.

In another embodiment, the seal of the cup is configured to be removed as a whole. Thus, when the seal is removed from the cup it is torn from the cup to such an extent that there are no parts of the seal left on the cup.

It is noted that because the cup is sealed with a seal that is only to be removed prior to use, the inside surface of the cavity is also free from contamination. The cup section of the cup can thus form part of the feeding bottle, i.e. at least partially define the cavity in which the infant formula is to be mixed with water, without the need of sterilizing the cup.

In a preferred embodiment, the teat engages the flange of the cup, such that the inside cavity of the feeding bottle is defined by the teat and the inside of the cup. In such an embodiment only the teat, which is used multiple times, needs to be decontaminated prior to use. The other components of the feeding bottle do not come into contact with the mixed infant formula, and therefore cannot contaminate it.

According to the invention the mixing cavity of the feeding bottle is at least partially defined by the teat and the cup, more in particular the cavity of the cup holding a single serve of infant formula to be mixed with water, i.e. the inner volumes of the teat and the cavity of the cup are part of the mixing chamber.

It is furthermore noted that the volume of the mixing chamber is such that it can hold a single serve of infant formula, the correct volume of water to be mixed with the single serve of infant formula, and an additional volume, or head space, to enable the water and the infant formula to be properly mixed by shaking the feeding bottle. Alternatively, there is no or little head space when the mixing cavity is filled with infant formula and the appropriate volume of water and the mixing is mainly achieved by kneading the teat and/or a flexible cup section of the cup.

In an embodiment, the teat and the cup together form at least 70%, preferably at least 80% of the volume of mixing cavity. In a preferred embodiment, in an assembled state of the feeding bottle, the teat directly engages the flange of the cup and the teat and cup together form 100% of the mixing cavity.

It is noted that with a feeding assembly according to the invention the cup is configured for holding a single serve of infant formula. Although this allows for some head space, it is noted that the volume of the cavity of the cup is not sufficient for holding the single serve of infant formula and the correct volume of water to be mixed with the single serve of infant formula.

In an embodiment according to the invention, the cup has a cup section that defines a cavity holding the infant formula, a dispensing opening that provides an entrance to said cavity, and a flange that extends along said dispensing opening, and, in an assembled state of the feeding bottle, the teat directly engages the flange of the single serve cup, such that the teat and the single serve cup together define the mixing cavity. Thus, in principle only the teat needs to be sterilized prior to use, since the cup, more in particular the cavity of the cup holding the single serve of infant formula, has been protected by the seal against any contamination.

In an alternative embodiment, the teat does not directly engage the cup. In this embodiment the mixing cavity is further defined by part of the mounting ring and/or part of the cup holder. In such an embodiment, the cup may be secured in the cup holder by the mounting ring, the mounting ring clamping the cup, preferably by its flange, in the cup holder. As an alternative or in addition, a securing device is provided that is configured for securing the cup in the cup holder. For example a securing ring can be provide that is to be coupled with the cup holder such that it engages the cup, preferably the flange of the cup and secures the cup in the cup holder, for example clamps the flange of the cup onto a support surface of the cup holder.

In an embodiment according to the invention, the base of the teat is provided with a flange, the flange extending in an outward direction, and the mounting ring is provided with a flange, the flange extending in an inward direction, for engaging the flange of the teat and clamping the flange of the teat onto the cup holder in an assembled state of the feeding bottle. Thus, the flange of the teat can be used to provide a sealing surface for providing a seal between the mounting ring and the cup holder. In an embodiment, the cup holder is provided with a resilient sealing ring or insert onto which the sealing surface of the flange of the teat is clamped to provide a seal between the cup holder and the teat.

In a further embodiment, the flange of the teat is made of a pliant material, for example a silicone material, for sealingly engaging the cup holder, i.e. providing a leak free coupling between teat and cup holder. Thus, no additional sealing ring or other components are required to provide a seal. In such an embodiment, the flange, the dome and the spout of teat preferably together form a single, integral component made of a resilient material, for example silicone.

In a further embodiment engages the flange of the cup when the feeding bottle is in its assembled state. Thus, the teat can be used for securing the cup in the cup holder. Preferably the flange of the teat is made of a pliant material, for example a silicone material, such that the teat can be used for securing the cup and at the same time providing a seal between the cup and the teat. Thus, no additional sealing ring or other components are required to provide a seal and/or to secure the cup in the cup holder. In such an embodiment, the flange, the dome and the spout of teat preferably together form a single, integral component made of a resilient material, for example silicone.

In an embodiment, the dome and the spout of the teat are integral, and the teat is made of a pliant material, preferably of a silicone material. In a further embodiment, the teat is provided with the flange extending in an outward direction, for cooperation with the clamping surface of the mounting ring as was set out above, for sealingly engaging the cup holder, preferably the flange of the cup held in the cup holder.

In an embodiment according to the invention, the mounting ring and the cup holder are provided with screw thread, such that the mounting ring can be screwed onto the cup holder for securing the teat onto the cup holder. This provides a simple and efficient way for coupling both components and is in particular useful when mounting the teat onto the cup holder is to be combined with clamping a resilient component of the teat onto the cup holder, preferably onto the flange of the cup held in the cup holder.

In an embodiment, multiple, for example double or triple, screw threads are provided on both the mounting ring and the cup holder. Thus a good clamping force can be obtained in combination with a comparatively small turning of the mounting ring to tighten and undo the mounting ring c.q. the teat. In an alternative embodiment, instead of screw thread an alternative fastening device is used, for example clamps and/or flexible fastening means such as a rubber or silicone string, or click fingers, etc.

The teat can be mounted in the mounting ring in several ways. It is observed that from the prior art many solutions are known for securing a teat in a mounting ring which can be used with little or no adaption for mounting a teat in a mounting ring according to the invention. In a preferred embodiment, the teat is provided with a protrusion, for example a flange, rib, or other shape, extending along its circumference, for cooperating with a cavity, for example form fits in a recess of the mounting ring. Alternative solutions can also be used. In an embodiment according to the invention, the mounting ring comprises multiple parts, for example a first ring to be screwed onto the cup holder and a second ring to be screwed into the first ring to secure the teat in the first ring. For example, the teat can be provided with a pliant flange that is to be positioned between the first and second ring, after which the second ring is screwed onto the first ring to secure the teat in the mounting ring.

In an embodiment according to the invention, the teat is integral with the mounting ring, or a part of the mounting ring, for example the teat and the mounting ring are joined by way of two component injection molding. When teat and mounting ring are an integral component, they are sealingly connected.

It is noted that when the mounting ring and/or the teat engage the flange of the cup when the feeding bottle is in its assembled state, the cup can be secured in the cup holder by simply mounting the teat onto the cup holder using the mounting ring. Such a configuration thus allows for an efficient assembly of the feeding bottle. Furthermore, when the material of the teat that is clamped onto the flange of the cup is a resilient material, for example a silicone material, no additional components, such as additional sealing rings, are required to provide a sealing coupling between teat and cup, which allows for an efficient fabrication of the product and reduces the chances on contamination since only a minimal number of components need to be sterilized prior to use.

In an embodiment, the cup holder is provided with a foot section, which foot section is configured such that when the cup holder is placed with its foot section upon a substantially horizontal support surface the cup can be lowered in the cup holder, and the cup is received in the cup holder in a position with the plane defined by its foil sealing surface of the flange of the cup substantially parallel to the support surface. For example, the cup holder may have a semi spherical shape, to fit the palm of the hand, which semi spherical shape is provided with a flattened bottom surface to allow the cup holder to be placed firmly on for example a counter- or table top.

In an embodiment, the foot section is provided with a foot section allows for two or more stable positions of the cup holder, and thus the baby bottle, on a flat surface, for example a table top. In such an embodiment, the cup holder is for example provided with a first flattened bottom surface that positions the cup holder in a first position, and as second flattened bottom surface that positions the cup holder in a second position. The first and second flattened bottom surfaces extending at an angle relative to each other, such that the feeding bottle when in the first position has an orientation that differs from the orientation of the feeding bottle when in the second position.

For example, in the first position the spout of the teat is direct upwards, while in the second position the filling opening is direct upwards and the tout is extends at an angle with the vertical. In such an embodiment, the first position the cup can be placed in the cup holder in a position with the plane defined by its foil sealing surface substantially parallel to the support surface, for example the table top. In the second position, the filling opening is directed upwards to facilitate filling of the feeding bottle.

In yet another embodiment, the filling opening is placed off center in the mounting ring and/or the teat, i.e. is not above the center of the filling opening of the cup held in the cup holder, and the teat and mounting ring are provided with multiple screw threads. In such an embodiment, the multiple screw threads allow for even so many positions of the teat and securing ring, c.q. the filling opening, to be mounted on the cup holder. For example, when the mounting ring is provided with two screw threads, the teat can be mounted with the filling opening in a first position and can be mounted with the filling opening in a second position, the first and second position enclosing a 180 degree twist and being mirrored by a plane of symmetry, the plane of symmetry comprising an central axis defined by the screw threads. In yet a further embodiment, the foot section provides two flattened bottom surface, extending at an angle relative to each other, and relative to a plane of symmetry, to provide the feeding bottle with two alternative filling positions, to cope with alternative positions of the filling opening as was described above, and a third flattened bottom surface, located between the first and second flattened bottom surfaces and perpendicular to said plane of symmetry, to provide the foot section with a position that allows for the cup to be placed in the cup holder in a position with the plane defined by its foil sealing surface substantially parallel to the support surface. Thus, the latter position is used when placing the cup in the cup holder and one of the other positions is used after the teat has been mounted on the cup holder to position the filling opening in a filling position.

Preferably, the cup holder provides a seat for holding the cup such that when the mounting ring an teat are removed, the cup is located closely to the top of the cup holder and the cup is easy to engage and manipulate when being poisoned into or removed from the cup holder.

In a further embodiment, the cup holder has a rounded bottom section, or has a bottom section with at least a rounded periphery, such that the feeding bottle has a substantially spherical shaped bottom end that first the palm of a hand. Thus the feeding bottle can be held with the bottom section in the palm of the hand and with the fingers of the hand engaging the mounting ring and/or the teat. In a further embodiment, the center of the bottom section is flat, or is provided with a raised central bottom section, such that the feeding bottle can stand on a flat support surface, such as a table top. In a furthered preferred embodiment, the cup holder, the mounting ring and the teat are configured such that they provide the feeding bottle with a substantially spherical shape.

In an embodiment according to the invention, the water fill opening is provided in the side of the feeding bottle, preferably at least in the mounting ring, such that a central axis of the water fill opening extends at a sharp angle, preferably extends substantially parallel, to a plane defined by the sealing surface of the flange of the cup held in the cup holder. Thus, when the feeding bottle is held with the water fill opening turned upwards, the cup held in the cup holder is turned sideways, for example is held on its side. Thus, when the water fill opening is used to fill the mixing cavity, the feeding bottle is held such that the cup is tilted, preferably is held sideways, and at least part of the single serve infant formula falls out of the cup and into the part of the mixing cavity defined by the mounting ring and/or the teat. This stimulates the mixing of the water with the infant formula while the water is fed into the mixing cavity.

Preferably, the water fill opening is provided just above the cup held in the cup holder, i.e. adjacent the sealing surface of the flange of the cup held in the cup holder, and just below a part of the base of the teat that extends above the mounting ring.

In a further embodiment, the water fill opening of the feeding bottle is provided in the mounting ring and in a part of the teat that is held in the mounting ring. In such a configuration the water fill opening extends through both the mounting ring and the teat, which is in particular beneficial when the mixing cavity is defined by the cavity of the cup and the teat. When the mixing cavity is defined by only the cup and the teat, the water fill opening has to extend through either the cup or the teat to provide access to the mixing cavity. By providing the water fill opening in both the mounting ring and the teat, the mounting ring can be used to provide a rigid base, compared to the flexible teat, for mounting the closing device. For example when the closing device is provided in the form of a plug that has to be inserted in the water fill opening, either by clamping or screwing it in a closing position, the mounting ring can provide a rigid base that supports the part of the teat in which the water fill opening is provided, to thus facilitate inserting the closing device. In a further embodiment, the closing device and an inside surface of the water fill opening provided in the mounting ring and/or in the teat is provided with screw thread and/or ribs to secure the closing device in the water fill opening, which closing device preferably is also provided with screw thread and/or ribs, for example is a resilient plug with a ribbed outer surface, for cooperating with the ribs and/or screw thread of the water fill opening.

In a further embodiment, the water fill opening is provided in the mounting ring and in a part of the teat, and part of the teat extends in the water fill opening provided in the mounting ring to provide the opening in the mounting ring with an inner sealing surface for sealingly engaging a closing device, for example a closing device in the form of a plug. In a further embodiment, the a plug can be provided with screw thread and or ribs to further secure the plug in the resilient surface provided by the teat.

In an embodiment, the spout of the teat is placed off center on the base of the teat, such that a central axis of the water fill opening and a central axis of the spout enclose an angle smaller than 90 degrees, preferably enclose an angle between 30 and 70 degrees, for example enclose an angle of 45 degrees. In this configuration, the spout is not provided at the top of the spherical base of the teat. Instead, the central axis of the spout extends at an angle to a plane defined by the sealing surface of the flange of the cup held in the cup holder. Thus, when the feeding bottle is held with its water fill opening turned upward, i.e. with the central axis of the water fill opening essentially vertical, for filling the mixing cavity with water, the spout of the teat is directed upwards. In this position, infant formula present in the spout would fall back into the base of the teat, which prevents the spout from getting clogged during the mixing process. It may also prevent leakage from the sucking opening or openings provided in the spout of the teat during the filling of the mixing cavity with water.

In an embodiment, the feeding assembly further comprises a beaker, for filling the feeding bottle with water via the water fill opening, which beaker is provided with a spout for cooperating with the water fill opening of the feeding bottle. Thus, the beaker can be used for filling the feeding bottle, when in its assembled stated, holding the opened cup, with the volume of water to be mixed with the single serve infant formula held in the cup.

In an embodiment, the beaker is a measuring beaker configured for measuring the correct volume of water for the amount of infant formula held in the cup. In a further embodiment, the feeding assembly is configured to be used with different sized cups, i.e. with cups that each have a cavity dimensioned to hold specific amount of infant formula, for example cups for holding a medium serve of infant formula, cups for holding a regular serve of infant formula and cups for holding a large serve of infant formula. In such an embodiment, the beaker is preferably provided with markings that indicate the correct volume of water required for a medium serve, for a regular serve and for a large serve.

It is noted that, the correct amount of infant formula needed for feeding an infant is typically coupled to the weight of the infant. By providing types of cups that differ in the size of their cup section and/or by filling one type of cup with different amounts of infant formula, cups can be provided of which the contents of infant formula match with predetermined weight ranges. Thus, for example, when preparing a feeding bottle for an infant, a type one cup is used when the weight of the infant falls within a first weight range and a type two cup is used when the weight of the infant falls within a second weight range, wherein the type two cup differs from the type one cup in the size of its cup section and/or the amount of infant formula held in the cup section.

In an alternative embodiment, the feeding bottle is provided with markings which indicate up to where the feeding bottle needs to be filled with water to provide enough water for the amount of formula held in the cup. For example, when the teat is translucent it shows the water inside the mixing cavity. When the water fill opening is provided in the side of the feeding bottle, the teat will at least partially fill with water during the filling process. In such an embodiment, markings that indicate up to where the feeding bottle needs to be filled can be provided on the teat and/or on the mounting ring adjacent the teat.

In an embodiment, the spout of the beaker is configured to be inserted into the water fill opening, thus providing a connection between beaker and feeding bottle, reducing the chance of spilling water during the filling process.

In a further embodiment, the water fill opening and or the spout of the beaker is provided with a sealing device, for example a resilient sealing surface, for example a rubber sealing ring, to provide a water tight coupling by inserting the spout of the beaker into the water fill opening. In an embodiment, the water fill opening is provided with a resilient inside surface provided by part of the teat extending into an opening provided in the mounting ring, for sealingly engaging the spout of the beaker. In a further embodiment, the water fill opening is provided with a sealing device that is configured for cooperation with the spout of the beaker and for cooperation with the closing device, for example a plug, for closing the water fill opening after filling the feeding bottle.

In a further embodiment, the spout of the beaker has the shape of closed conduit, extending between an inlet opening and an outlet opening. Preferably, the outlet opening of the conduit is provided at the top of the beaker, providing the beaker with a configuration roughly similar to a teapot or watering can. Thus, the beaker is configured for being tilted over an angle, for example over an angle of about eighty degrees, when filling the feeding bottle with a reduced chance of the contents of the beaker spilling through the filling opening. This allows for filling the feeding bottle while it is held in a position with the water fill opening facing upwards, and is especially beneficial when the spout of the beaker is configured to be coupled with the water fill opening.

In an alternative embodiment the spout of the beaker has the shape of a closed conduit, extending between an inlet opening and an outlet opening, and is provided in the bottom of the beaker, the filling opening of the beaker being provided at its top. In such an embodiment, the spout is furthermore provided with a valve, which is to be opened after the spout has been positioned above the water fill opening of the feeding bottle. In a further embodiment, the valve is configured such that it automatically opens when the spout engages the water fill opening, i.e. is inserted into the water fill opening, and automatically closes when the spout is retracted from the water fill opening. Thus, the beaker does not need to be tilted during the filling, and, in particular when an automatic valve is provided, the chance of spilling water during the filling process is reduced. Furthermore, providing the automatic valve facilitates the filling process and allows for simply holding the feeding bottle in one hand and the beaker in another hand.

To facilitate the filling process, the feeding bottle can be configured to stand on a horizontal support surface with its water fill opening turned upwards, or a stand can be provided for holding the feeding bottle in a position with its water fill opening turned upwards.

Also, a funnel can be provided that is to be inserted into the water fill opening to allow filling of the feeding bottle by pouring water into the funnel. In a preferred embodiment, the funnel and the water fill opening are configured such that the funnel can temporarily be fixed in the water fill opening, for example can be clamped in the water fill opening, for example by cooperating with the means provided for mounting the closing device on or into the water fill opening.

In a further embodiment, the spout of the beaker and the water fill opening of the feeding bottle are shaped such that the outer shape of the spout fits the inner shape of the water fill opening. For example, both can be provided with a with a similar shaped cross section, for example a circular or oval shaped cross section.

In an embodiment, the beaker is adapted to be secured on the feeding bottle in a storage position. Preferably, the beaker is dimensioned to cover the teat when the beaker is mounted on the feeding bottle in its storage position. A fastening device is provided, for example in the form of click fingers or screw thread provided on the outside of the mounting ring and on the inside of the beaker, to releasable secure the beaker on the feeding bottle in its storage position.

In an alternative embodiment a funnel is provided, which funnel is configured to be mounted in the water fill opening to facilitate filling of the feeding bottle, and which is adapted to be secured on the feeding bottle in a storage position. Preferably, the funnel is dimensioned to cover the teat when it is mounted on the feeding bottle in its storage position. Preferably a fastening device is provided, for example in the form of click fingers or screw thread provided on the outside of the mounting ring and on the inside of the beaker, to releasable secure the beaker on the feeding bottle.

According to the invention, the feeding assembly comprises a sealed cup, the sealed cup having a cavity holding a single serve of infant formula to be mixed with water. In an embodiment, the cup has a cup section that defines the cavity holding the infant formula, a dispensing opening that provides an entrance to said cavity, and a flange that extends along said dispensing opening. The flange thus provides a surface for attaching the seal to the cup such that the cavity is sealed, i.e. a seal attachment surface or foil sealing surface of flange of the cup.

In an embodiment, the cup is shallow bowl, i.e. the cavity has a width that is at least two times the depth of the cavity preferably is at least three times the depth of the cavity, wherein the depth of the cavity is measured from a plane defined by the sealing surface of the flange of the cup to the deepest point of the cavity. Thus, when the cavity is provided with a bottom section having a raised central section, preferably a convex shaped central bottom section, the deepest part of the cavity extends around said raised central section. Such a shallow cup facilitates the mixing process, because when the seal is removed, a large surface area of the body of infant formula is exposed for contact with water. Furthermore, with a bowl shaped cup the infant formula is less likely to get stuck in the cup as is the case with a narrow and deep shaped cup. Thus, when the feeding bottle is held in a filling position with its water fill opening directed upwards, and the cup thus held sideways, infant formula will fall from the cup into the mixing cavity to be mixed with water.

In an embodiment, the apex or top of the raised central bottom section of the cup is located in the upper half of the cup section. Thus, the height of the raised central bottom section is at least half the depth of the cup.

In an embodiment, the cup has a cup section which is shaped substantially similar to the base of the teat, such that when the cup section is turned inside out, i.e. the cup section is moved through a dispensing opening of the cup from one side of a flange of the cup extending along said dispensing opening to an opposite side of said flange, the cups section can be positioned inside the dome shape part of the teat, such that the cup section is located adjacent the inside surface of the teat. When such a cup, in the assembled state of the feeding bottle, together with the teat defines the mixing cavity of the feeding bottle, than turning the cup inside out cancels, or at least substantially cancels, the mixing cavity, i.e. minimizes the volume of the mixing cavity. When the cup furthermore has a flexibility such that an infant sucking the teat can turn the cup inside out, the transformation of the cup during the feeding process allows an infant to suck all the contents from the mixing cavity without the sucking of the infant leading to a vacuum or a substantial underpressure in the mixing cavity.

In an embodiment, the cavity of the cup is dimensioned to hold a single serve of infant formula to be mixed with water, e.g. hold between 8 and 28 gram of infant formula for example between 12 and 22 gram, for example hold 17.5 gram of infant formula. Preferably, cups are provided with different amounts of infant formula, for example cups holding 8.5 gram of infant formula, cups holding 13 gram of infant formula and cups holding 17.5 gram of infant formula.

In an embodiment, the cup has a cup section with a height between 15 and 30 mm, for example 27 mm, and has a diameter between 60 mm and 80 mm, for example 68 mm. In an embodiment, the cup has a cup section with a height between 15 and 28 mm, for example 20 mm, and has a diameter between 68 mm and 80 mm, for example 78 mm. In an embodiment, the diameter of the cup section is between 2 and 5 times the height of the cup section, for example is 2.5 times the height of the cup section.

In an embodiment, the cavity of the cup has an inner volume between 15 and 60 ml, for example 18 ml, 28 ml or 42 ml for holding between 8 and 26 gr of infant formula, wherein the inner volume of the cup is the volume of the cavity as defined by the cup, more in particular the cup section of the cup, and the seal sealing the cavity of the cup. The cup is preferably dimensioned to allow for some head space when filled with the infant formula.

In an embodiment, the cup is a pre shaped but pliable plastic cup, made from plastic sheet material, for example a sheet of PA and/or PE material, using the thermoform technique. It is noted that such a sheet may comprise layers of different materials, the combination of materials providing the sheet, and thus the cup made therefrom, with the correct properties. For example, the sheet may comprise a layer of material for providing the cup with the correct barrier properties and a layer of material for providing the cup with the correct resilient properties. A disposable single use package according to the invention can be provided by filling the cup with a single serve of infant formula to be mixed with water and subsequently sealing the cup with a seal that can be removed by hand. Typically, a seal is mad of a foil type material. The seal can be made of a Polyester, PE or aluminum-PE material. The seal can also be made from a combination of different materials, the combination of materials providing the seal with the correct properties, for example one material for providing the seal with the correct barrier properties combined with a layer of material for providing the seal with a surface that can be sealed to the cup using a sealing technique, for example a heat sealing technique. A cup according to the invention thus allows for efficiently producing multiple single use cups each holding a single serve of infant formula, for example, multiple cups can be thermoformed from a sheet of PA and/or PE material, which cups are filled with infant formula, sealed and cut from the sheet. This can be done under sterile conditions, such that when the seal of a cup is removed, the inside of the cup and its contents are free from contamination and are thus ready for use in the feeding bottle. It is noted that alternative manufacturing techniques for providing cups filled with food stuff, such as infant formula, can also be utilized to provide cups according to the invention.

In an embodiment according to the invention, the cup has a cup section that defines the cavity holding the infant formula, a dispensing opening that provides an entrance to said cavity, and a flange that extends along said dispensing opening. The cup section of the cup preferably has a flexibility that allows the cup section to flip inside out, i.e. to through the dispense opening from one side of the flange to the other side of the flange, to allow an infant to suck empty the mixing cavity form its contents by sucking the spout of the teat. The cup is however a pre-shaped cup and not a flexible bag with a flange. Thus, the cup, in particular the flexible cup section of the cup, holds its shape up to the feeding process. It can for example be set on a support surface without losing its shape. This in contrast with a fully flexible bag, which has no pre-defined shape.

In a further embodiment the feeding assembly is configured to be used with different sized cups, i.e. with cups that each have a cavity dimensioned to hold specific amount of infant formula, for example cups for holding a medium serve of infant formula, cups for holding a regular serve of infant formula and cups for holding a large serve of infant formula. In such an embodiment, the cups preferably only differ in the dimension of the cavity, while the flange of the cups, or at least the outer circumference of the flanges, is similar in size and shape or even identical, such that the different types of cups all fit the cup holder in the same manner, and can be clamped in position in the cup holder in the same way.

In an alternative embodiment, the different sized cups also differ in the shape and/or dimension of the flange of the cup.

In such a case the cup holder can be configured for holding different sized and/or different shaped flanges. Alternatively, an adapter element can be provided, for example in the shape of an adapter ring or collar, which adapter element is to be mounted on the flange of the cup or in the cup holder when a different type of cup is used, i.e. a cup with a size or shape that differs from the shape or size of a regular cup. For example, the cup holder can be configured for receiving a large sized cup, and can by way of mounting an adapter ring in the cup holder be adapted to receive a normal sized and/or small sized cup. In another embodiment, the mounting ring and/or the cup holder is replaced with a different sized mounting ring and/or cup holder to make the feeding bottle fit for use with a type of cup having a different size and/or shape. For example, the feeding bottle can first be configured for used with small sized cups, and, when the infant has grown and requires larger portions, can be adapted to be used with a larger sized cup.

In an alternative embodiment, a single type of cup is used with different amounts of infant formula by simply providing the cup with a cavity large enough to hold a large size serve of infant formula and using this type of cup also for packaging regular and/or medium sized serves.

In an embodiment, the outer circumference of the flange of the up is circular shaped. In an alternative embodiment, the outer circumference of the cup is non circular, for example has a hexagonal shape. Preferably, the cup holder is provided with a seat for receiving the cup, which is provided with a recess that form fits the outer contour of the cup. Thus, when a cup with an outer circumference having for example a hexagonal shape is positioned in the seat, the form fit prevents the cup form pivoting about an axis perpendicular to a plane defined by the flange of the cup.

In an embodiment, the flange of the cup has a bottom side that provides a planar and annular shaped support surface and a topside that provides a planar and annular shaped sealing surface, and is provided with a rim extending at an angle with the support surface, preferably at a substantially right angle with the support surface of the flange of the cup, and wherein the cup holder is provided with a recess for receiving the rim of the cup, or with an edge for hooking behind the rim of the cup, to secure the cup in the cup holder. Thus, the cup and the cup holder are configured for securing the cup in its position in the cup holder, in particular such that the flange of the cup is prevented from sliding along the support surface when the cup has been positioned in the cup holder. This configuration provides the cup with additional stability when positioned in the cup holder, which is especially beneficial when the cup is made of a flexible material. Thus, for example, the sealed cup can be positioned in the cup holder to provide the user with additional grip, and the cup with additional support, to facilitate tearing the seal form the cup by the user. For example, in an embodiment, the cup holder is provided with a support surface for supporting the flange of the cup, in which support surface a recess is provided for receiving the rim provided on the flange of the cup. Thus, when the cup is positioned in the cup holder, resting with the support surface of the flange of the cup on the support surface of the cup holder, the rim fits the recess provided in the support surface, and the cup is further secured in the cup holder, in particular the flange of the cup is secured against movement along the support surface of the cup holder.

In another embodiment, the flange of the cup is at its outer circumference provided with a rim, which rim extends at an angle with the flange in a downward direction away from the flange and inward towards the cup section of the cup. In this embodiment, the cup holder is provided with a support surface for supporting the flange of the cup, which support surface is dimensioned such that its circumference ends just short of the circumference of the flange of a cup supported in the cup holder, such that the rim of the cup extends below said support surface of the cup holder and thus effectively hooks behind said surface. In an alternative embodiment, the rim may not hook below the support surface of the cup holder but clampingly engage a wall section or rim extending below and along the periphery of the support surface of the cup holder.

Providing the cup with a rim to further secure the cup in the cup holder furthermore prevents the cup, more in particular the rim of the cup, from slipping inward when the cup is part of the assembled feeding bottle, and thus prevents substantial transformation of the flange when the cup is held in the feeding bottle. This is especially beneficial when the cup is configured to "transform" during the feeding process, i.e. is provided with a cup section that is configured to at least partially collapse and/or billow inward due to an underpressure inside the feeding bottle caused by the feeding infant sucking of the teat.

The rim may extend along the entire circumference of the flange, or only along sections thereof. In a further embodiment, the cup is secured in the cup holder for example by providing perforations in the flange of the cup during the fabrication process, and providing the cup holder with pins that fall in those openings when the cup is positioned in the cup holder.

In yet another embodiment, sections of the flange of the cup are folded in an upward or downward direction and are inserted in slots in the cup holder or the mounting ring to secure the cup in the cup holder, in particular prevent lateral movement of the flange of the cup during the feeding process.

In an embodiment, the cup has a cup section that defines the cavity holding the infant formula, a dispensing opening that provides an entrance to said cavity, and a flange that extends along said dispensing opening, and at least part of the cup section of the cup has a flexibility that enables, when the opened cup is mounted in the feeding bottle, the bottom section, or at least a part thereof to collapse inwards, i.e. to billow towards the entrance opening of the cup and preferably through said dispensing opening up and into the teat, to balance out a underpressure created inside the feeding bottle caused by an infant drinking from the feeding bottle.

Thus, the flexibility of the cup compensates any underpressure generated in the feeding bottle during the feeding process. It is noted that it is known in the prior art to provide feeding bottles with so called liners, which liners typically transform a feeding bottle in a fully flexible drinking bag. By providing a feeding assembly according to the invention with a sealed cup holding a single serve of infant formula, and utilizing the single use packaging cup as a functional part of the feeding bottle, there is no need to provide the feeding bottle with a separate liner which would not only require an additional component, but also the transfer from the infant formula form the cup into the liner.

In an embodiment of a feeding assembly according to the invention, the cup section of the cup has a flexibility that enables, when the opened cup is mounted in the feeding bottle, the cup section to collapse inwards, i.e. to billow towards the dispensing opening of the cup, and to billow through said dispensing opening up and into the teat, to balance out an underpressure created inside the feeding bottle caused by an infant drinking from the feeding bottle. Thus, the full cup section can billow through the dispensing opening of the cup, flipping the cup section from the bottom side of the flange to the sealing side of the flange, and thus turning the cup section inside out, i.e. the inside surface of the cup section faces outwards when the cup section is fully collapsed, i.e. the cup section is in its fully billowed condition inside the teat. Thus, the flexibility of the cup is optimally used for preventing underpressure, or vacuum, in the mixing cavity during the feeding process.

In a further embodiment of a feeding assembly according to the invention, the cup section is configured for billowing through the dispensing opening of the cup up and into the teat, and the cup section of the cup is dimensioned such that the cup section in its fully billowed condition lies along the inner surface of the teat. Thus, there is no or only little space left between the teat and the cup when the latter is in its fully billowed condition, and the mixing cavity is essentially cancelled out by the cup section. It is noted that when this embodiment is furthermore configured such that the teat and cup together define the mixing cavity, i.e. in the assembled state of the feeding bottle the teat engages the flange section of the cup, the inner volume of the teat is preferably substantially similar to the volume of the cup section of the cup.

In such an embodiment the inside of the teat and/or the cup are preferably provided with channels, cannelures, ribs or protrusions around at least the base of the spout and/or the part of the cup located around the base of the spout when the cup is turned inside out, to prevent the cup from sealing off access to the spout. Providing the channels, cannelures, ribs or protrusions thus allows for any mixed baby formula present between the cup and the teat to flow towards and into the spout of the teat, even if the cup is fully billowed, i.e. turned inside out, and lies adjacent the inside of the teat.

It is noted that the teat can be provided with a flexibility that enables the teat to collapse during the feeding process to counterbalance a vacuum in the mixing cavity. However, when the cup of a feeding assembly is configured to billow towards or even through the dispensing opening during the feeding process, the flexibility of the teat and the flexibility of the cup should be such that during the feeding process the cup collapses first, and the teat only collapses after the cup is in its fully collapsed position. In the embodiment that the cup section is configured to billow through the dispensing opening and adjacent the inside surface of the teat, therefore the teat does not, or only to a small extend, collapses during the feeding process.

In an embodiment, the walls of the cup extend in a direction substantially perpendicular to the flange of the cup, which is especially beneficial when the cup is provided with a raised central bottom section. In such a configuration the steep sidewalls are especially prone to rolling upwards, i.e. towards the flange, during the billowing of the cup. In a further embodiment, the transition between walls and bottom of the cup, as well as the transition between the bottom of the cup and the raised central bottom section of the cup, are curved surfaces, which further stimulates the billowing effect of the cup.

In an embodiment, wherein the flange of the cup has a bottom side that provides a support surface and a topside that provides a sealing surface, the cup section, in a plane parallel to the support surface of the flange of the cup has a circular shaped cross section. Thus, the cup section is free from corners present with an angular shaped cross section, which is beneficial to the billowing of the bottom section towards and through the opening.

In a further embodiment, the cup is provided with a raised central bottom section. In a further embodiment, the cup section of the cup is provided with a raised central bottom section, preferably a convex shaped central bottom section of which the apex is directed to the dispensing opening of the cup, to further propagate the billowing of the cup during feeding. It has been found that providing the cup, more in particular the cup section of the cup, with a convex shaped central bottom section propagates billowing of through the dispensing opening. In a particular advantageous embodiment, the convex shaped central bottom section is dome shaped and curved, such that there is a smooth transition between the convex shaped central bottom section and the surrounding cup section of the cup. The curved transition between raised bottom section and the surrounding bottom section of the cup enables a gradual and smooth transformation of the cup. This is in particular the case when the cup section, in a plane parallel to a support surface provided by the bottom side of the flange of the cup, has a circular shaped cross section, more in particular when the convex shaped central bottom section has a circular cross section.

In an alternative embodiment, the form of the convex shaped bottom section may differ, for example be more conical in shape, or more triangular, e.g. have a pyramid shape, or have a cylindrical shape, etc. Also, the convex shaped central bottom section may be provided with additional recesses e.g. have a corrugated surface, for example to provide the bottom with bellow type characteristics.

It is observed that by providing the cup section of the cup with a convex shaped central bottom section, of which the apex is directed to the dispensing opening of the cup, the length of the walls of the cup section, i.e. the combined side wall and bottom wall of the cup section, is enlarged which enables the cup to be dimensioned such that the walls of the cup, or at least a part thereof, is positioned against the inside of the teat when the cup is collapsed and billowed through the dispensing opening of the cup.

It is observed that by providing cups that differ in the size of the convex shaped central bottom section, cups can be provided that differ in the of the cavity defined by the cup section, without changing the overall dimensions of the cup. Thus, the cups that differ in the volume of their cavity all fit the same cup holder.

It is observed that the invention in an embodiment provides a sealed cup for a feeding assembly, which cup is configured for collapsing inward and billow through the dispensing opening during the feeding process. Such a cup is preferably made of a flexible material which might provide the overall cup with a lack of rigidity, which in turn makes it difficult or even impossible for a user to hold the cup and tear off the seal. This can partially be solved by providing the cup with a comparatively rigid flange and a comparatively flexible cup section, for example by providing the cup section of the cup with comparatively thin walls. In addition, or as an alternative, the flange of the cup can be provided with a rim, as was explained above, to provide the cup with additional rigidity and to allow the cup to be secured in the cup holder by providing the cup holder with a recess or edge for holding and/or hooking behind the rim when the cup is inserted into the cup holder. The rim can furthermore be provided as a grip surface for holding the cup when located in the cup holder. Also, the rim may further be used to secure the cup in the cup holder during the feeding process, and prevent the rim of the cup from slipping inward. Thus, according to the invention, a flexible cup can be provided which allows for transformation of the cup during the feeding process, and which cup is sealed with a seal to be torn off by the user prior to use.

In an embodiment, the cup holder is provided with a bottom section, which shields the cup when the feeding bottle is in its assembled state. Such a bottom section preferably is spherical shaped such that it enhances the fit of the feeding bottle in the palm of the hand. Furthermore, by providing the cup holder with such a bottom section the cup, in particular the cup section of the cup, is shielded from accidental manipulation during use.

In a further embodiment, the cup holder is provided with a raised central bottom section, which raised bottom section is configured to support at least a central part of the convex shaped central bottom section of the cup received in the holder, to prevent the convex shaped central bottom section from billowing outward, i.e. away from the dispensing opening of the cup. This is especially beneficial when the cup is highly flexible, and for example after removal of the seal has the tendency to bulge outward when the feeding bottle is filled with water.

In a further embodiment, the raised bottom section of the cup holder has a convex shape, configured to substantially fit the convex shaped central bottom section of the cup received in the cup holder. This allows to use the feeding bottle with a highly flexible cup, which cup is provided with a convex shaped central bottom section, of which the apex is directed to the dispensing opening of the cup, to further facilitate the billowing of the cup during feeding. Such a cup may, due to its high flexibility, have the tendency to billow outward when the feeding bottle is filled with water and/or during the mixing process, especially when the mixing is achieved by shaking the feeding bottle. Thus, providing the feeding bottle according to the invention with a cup holder having a bottom section that fits a raised convex shaped bottom section of a cup held in the cup holder, allows for using that feeding bottle with a highly flexible cup which is optimally configured for billowing into the teat during the feeding process.

In a further embodiment, the bottom section, in particular the raised bottom section, of the cup holder is provided with one or more openings to allow outside air to flow into the cup holder during the inwards collapse, i.e. billowing towards and optionally through the dispensing opening of the cup.

In an embodiment, the cup is comparatively stiff such that it keeps its form during the feeding process. In such an embodiment, the teat and/or the mounting ring and/or the cup holder is provided with a valve that allows for air to enter the feeding bottle when a vacuum is generated during the feeding process. In another embodiment, the feeding bottle is provided with such a valve as well as with cup that is configured to transform during the feeding process.

Providing feeding bottles with such valves is common practice in the prior art, and is as such not considered to involve inventive step. Therefore this aspect will not be further elaborated upon.

According to the invention, the cup has a cavity holding a single serve of infant formula to be mixed with water, which cavity is sealed with a seal that is at least partially removed from the cup prior to use. In an embodiment according to the invention, the single serve flexible cup comprises a seal for contamination free holding the infant formula prior to mixing the infant formula with water.

In a further embodiment, the seal is a tear of seal which is attached to the sealing surface of the flange of the cup. In such an embodiment, the seal is configured to be at least partially torn away from the cup to open up the cavity of the cup to make the infant formula available to be mixed with water.

The invention thus also provides a disposable single use package, comprising a sealed infant formula cup holding a single serve of infant formula to be mixed with water, for providing an infant feeding assembly according to the invention.

The invention furthermore provides a sealed cup for providing a feeding assembly according to the invention, the sealed cup holding a single served of infant formula.

In an embodiment, the sealed infant formula cup according to the invention has a cup section that defines a cavity, a dispensing opening that provides an entrance to said cavity, and a flange that extends along said dispensing opening, wherein the flange of the cup has a bottom side that provides a planar and annular shaped support surface and a topside that provides a planar and annular shaped sealing surface, wherein the cavity had a depth extending in a direction perpendicular to a plane defined by the sealing surface of the flange of the cup, and a diameter extending in a plane parallel to a plane defined by the sealing surface of the flange of the cup, wherein the width of the cavity is larger than its depth, preferably at least 1.5 times larger, more preferably at least 2 times larger, and wherein the cavity of the cup is at least partially filled with infant formula, and a seal has been attached to the sealing surface of the flange of the cup such that the seal seals off the dispensing opening, the sealed infant formula cup thus providing a disposable single use package holding an amount of infant formula for providing a single serve of infant formula when mixed with water.

In an alternative embodiment, the sealed infant formula cup according to the invention has a cup section that defines a cavity, a dispensing opening that provides an entrance to said cavity, and a flange that extends along said dispensing opening, wherein the flange of the cup has a bottom side that provides a planar and annular shaped support surface and a topside that provides a planar and annular shaped sealing surface, wherein the cavity had a depth extending in a direction perpendicular to a plane defined by the sealing surface of the flange of the cup, and a diameter extending in a plane parallel to a plane defined by the sealing surface of the flange of the cup, wherein the cavity of the cup is at least partially filled with infant formula, and a foil seal has been attached to the sealing surface of the flange of the cup such that the seal seals off the dispensing opening, the sealed infant formula cup thus providing a disposable single use package holding an amount of infant formula for providing a single serve of infant formula when mixed with water, wherein the cup is made by thermoforming from a plastic sheet material, and wherein at least part of the cup section has a flexibility that enables, when the cup is mounted in the feeding bottle, the bottom section to billow inwards, i.e. towards the entrance opening of the cup and preferably through said dispensing opening, to balance out a under-pressure created inside the feeding bottle caused by an infant drinking from the feeding bottle.

In an embodiment, the invention provides an infant feeding assembly comprising a feeding bottle and a sealed cup, the sealed cup holding a single serve of infant formula to be mixed with water, wherein the cup has a cup section that defines a cavity holding said infant formula, a dispensing opening that provides an entrance to said cavity, and a flange that extends along said dispensing opening, the flange of the cup having a bottom side that provides an annular shaped support surface and a topside that provides a planar and annular shaped sealing surface, and a seal that has been attached to sealing surface of the flange of the cup such that the seal seals off the dispensing opening, wherein the feeding bottle comprises:

- a cup holder, adapted to hold the cup in its opened condition, i.e. with its seal removed or broken, which cup holder has a cavity for receiving the cup section of the cup, a receiving opening that provides an entrance to said cavity, and a rim, e.g. a flange shaped rim, that extends along said receiving opening, which rim of the cup holder provides an annular support surface for supporting the flange of the cup when said cup is received in the cavity of the cup holder,
- a teat, having a dome shaped base and a spout on that base, the teat mimicking a breast, and wherein the base is provided with a flange, the flange of the teat having a top side that provides a planar and annular shaped support surface and a bottom side that provides a planar and annular shaped sealing surface that engages the sealing surface of the cup when the opened cup is held by the cup holder;
- a mounting ring which releasable mounts the teat onto the cup holder, which mounting ring has a planar and annular shaped clamping surface that engages the support surface of the teat, such that, when the opened cup is held by the cup holder, the flange of the teat is located on the flange of the cup, and both the flange of the teat and the flange of the cup are located between the support surface of the cup holder and the clamping surface of the mounting ring, and and which mounting ring is provided with a releasable coupling device for coupling the mounting ring with the cup holder such that the mounting ring clamps the flange of the teat onto the flange of the cup to provide a seal; and
- a water fill opening, which fill opening is provided in the holder and/or in the mounting ring and/or in the base of the teat, through which fill opening the feeding bottle can be filled with water while the opened cup is received in the cup holder and the teat is mounted on the cup holder,
- a closure device adapted to seal said water fill opening to allow for mixing the infant formula, with the water filled into the feeding bottle, by shaking the closed feeding bottle.

The invention furthermore provides a feeding bottle as disclosed above, which feeding bottle is configured to be used with a single serve cup, in combination with a reusable flexible cup, for example a cup made from a silicone material. Providing a reusable flexible cup allows for use of the feeding bottle with alternative products, for example infant powder from a large volume package or mother milk, while providing the benefits of a feeding assembly according to the invention comprising a flexible cup. The reusable flexible cup can be filled with infant powder from a large volume package and be placed in the cup holder, or the flexible cup can be placed in the feeding bottle which is subsequently filled with milk via the water fill opening. In such an embodiment, the reusable flexible cup is to be sterilized prior to use. In an alternative embodiment, single use flexible cups are provided in a sealed package, or sealed cups are provided which do not comprise infant formula, to allow for use of the feeding bottle with alternative products.

The invention furthermore provides a method for preparing a feeding bottle, the method comprising the steps:

- providing a sealed cup, preferably a sealed cup according to the invention, the cup holding a single serve of infant formula;
- providing a feeding bottle, preferably a feeding bottle according to the invention, the feeding bottle comprising a cup holder for holding the cup, a teat, a mounting ring for mounting the teat onto the cup holder, and a plug for sealing a water fill opening, which water fill opening is provided in the holder and/or in the mounting ring and/or in the teat;
- placing the cup in the cup holder and removing the seal of the single serve cup;
- mounting the teat onto the holder using the mounting ring, preferably using the teat to clamp the cup in the cup holder;
- filling the feeding bottle via the water fill opening and closing the water fill opening after the feeding bottle has been filled with the correct volume of water; and
- mixing the infant formula, with the water filled into the feeding bottle, by shaking the closed feeding bottle.

It is observed that infant formula is a manufactured food concentrate for feeding babies and infants, and is prepared for bottle-feeding by mixing the powder or liquid food concentrate held in the cup with water. It is however noted that a feeding assembly according to the invention can also be used with a sealed cup holding a different type of food concentrate in powder form or fluid form. For example, the sealed cup can be used to hold a food concentrate for making pap or porridge like baby food by adding water or milk, can hold cacao for making or lemonade syrup to be mixed with milk or water respectively, etc.

The feeding assembly can also be provided with multiple teats, which teats differ in the size and/or shape of the sucking opening or openings provided in the spout. For example, a teat with smaller sucking openings can be used with a just born, and be replaced with a teat having lager sucking openings when the infant is 4 months old.

Also, the form and size of the teat may differ. For example, the dome may have a more flattened shape or a more pointing shape, to provide the feeding bottle with a smaller or larger filling cavity respectively.

In an embodiment, the feeding assembly further comprises a reusable cup for using the feeding assembly with infant formula, or different food concentrate, from wholesale packaging. The cup can be a partially or wholly flexible cup, for example made from silicone or a similar material. In a further embodiment, the reusable cup comprises a flange made of a rigid material and a cup part made of a flexible material. Other embodiments are also possible within the scope of the invention.

With respect to underpressure, i.e. a vacuum build-up that will occur within ordinary feeding bottles due to the infant feeding, it is observed that this is a known problem. The negative pressure (or vacuum) within known feeding bottles increases during the feeding, and becomes a resistance against the flow of liquid out of the bottle. Under such conditions, infants must exert an increasingly greater sucking force to counterbalance the increased vacuum in order to continue withdrawing mixed infant formula from the feeding bottle. Furthermore, the ordinary feeding bottles thus give rise to the infants getting colic to a more or less pronounced degree. Care should be taken to make the infants burp from time to time during their sucking. The reason is that they tend to continue their sucking until a relatively high vacuum is produced in the bottle, whereby they cannot avoid sucking in false air from outside the bottle teat. In an embodiment according to the invention, the feeding assembly comprising a cup with a flexible cup section, or a cup with at least a flexible bottom section, such that the during the feeding the cup transforms, more or less collapses and preferably billows through the dispensing opening of the cup into the teat. The transformation of the cup is generated by the sucking action of the infant. The transformation of the cup reduces the size of the mixing cavity and thus prevents a significant vacuum build-up from occurring. Thus, a feeding assembly according to the invention comprising a flexible cup, provides a feeding bottle that enhances the feeding process in a simple and efficient manner. Furthermore, when the flexible cup is a single serve, single use cup, it the flexible part of the cup, which becomes part of the mixing cavity of the feeding bottle, is ready for use when the seal has been removed. There is no need for sterilizing the flexible cup section because the part of the cup that defines the mixing cavity during use was kept under sanitary conditions by the seal. Therefore, the cup and its contents can be placed directly in the cup holder to be combined with the teat. It is noted that the teat and other components of the feeding bottle may require sterilization prior to the feeding bottle being assembled, i.e. the teat being mounted on the cup and cup holder.

Subsequently, water is fed into the mixing cavity via the water fill opening, and is mixed with the contents of the cup. It is noted that the water can be heated prior to being fed into the feeding bottle. As an alternative or in addition, the feeding bottle holding the water and the infant formula is heated, for example by placing the feeding bottle in the micro wave.

Advantageous embodiments of the feeding assembly according to the invention and the method according to the invention are disclosed in the subclaims and in the description, in which the invention is further illustrated and elucidated on the basis of a number of exemplary embodiments, of which some are shown in the schematic drawing.

BRIEF DESCRIPTION OF THE DRAWINGS

In the drawings:

FIGS. 7*a-d* show a side view in cross section of the feeding bottle of FIG. 4 in its assembled state, with the cup in subsequent working positions;

DETAILED DESCRIPTION OF THE INVENTION

Figure 1:
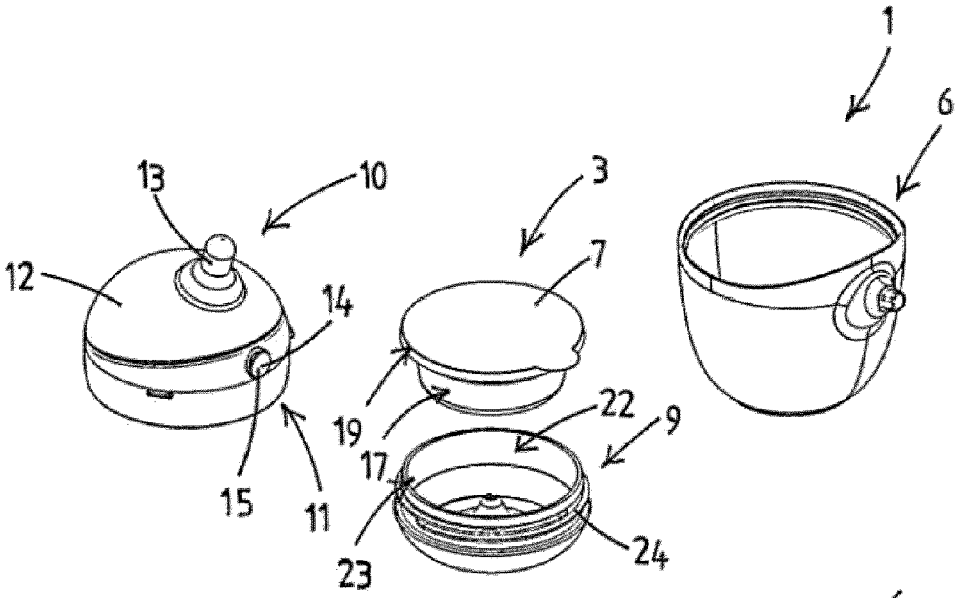
FIG. 1 shows a perspective view of a feeding assembly according to the invention, the feeding assembly comprising a sealed cup, a feeding bottle comprising a teat, a mounting ring and a cup holder, and a beaker for filling the feeding bottle.
Figure 2:
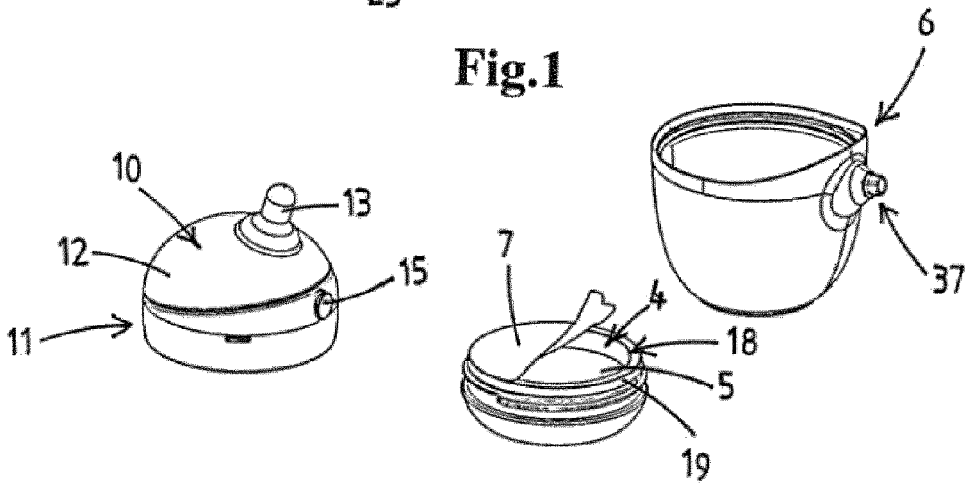
FIG. 2 shows a perspective view of the feeding assembly of FIG. 1, with the cup positioned in the cup holder and with the seal of the cup in the process of being removed.
Figure 3:
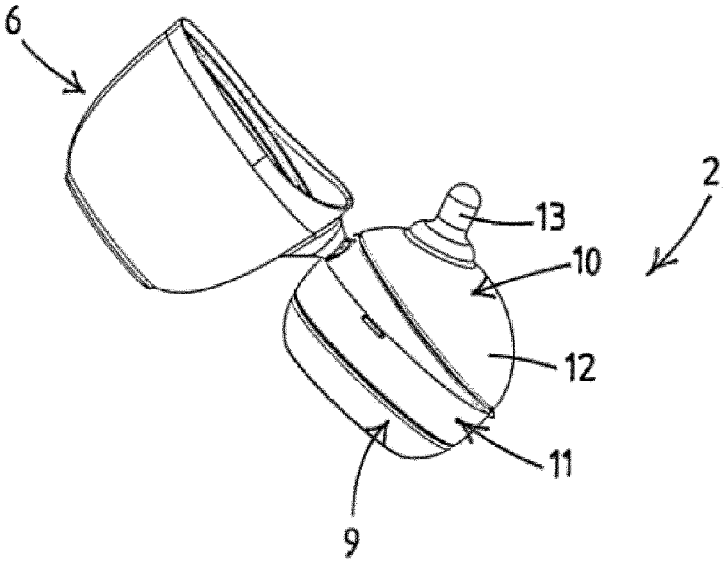
FIG. 3 shows the feeding assembly of FIG. 1, with the feeding bottle in its assembled state holding the unsealed cup, and with the beaker coupled with a water fill opening of the feeding bottle.

FIGS. 1-3 show a perspective view of a feeding assembly 1 according to the invention. The feeding assembly 1 comprises a feeding bottle 2 and a sealed cup 3. The cup 3 has a cavity 4 holding a single serve of infant formula 8 to be mixed with water. The particular feeding assembly shown in FIGS. 1-3 furthermore comprises an optional beaker 6 for filling the feeding bottle 2 with water.

In the particular embodiment shown, the single serve flexible cup 3 comprises a seal 7 for contamination free holding the infant formula 8 prior to mixing the infant formula with water.

According to the invention, the feeding bottle 2 is adapted to be used with the cup 3. During use, the cup 3 is held in an opened state, i.e. with its seal 7 removed or broken, in the feeding bottle 2, such that the single serve of infant formula 8 held by the cup can be mixed with water in the feeding bottle.

The feeding bottle 2 comprises a cup holder 9, a teat 10, and a mounting ring 11.

The cup holder 9 is adapted to hold the cup 3 in its opened condition. FIG. 2 shows the cup 3 positioned in the cup holder 9 and with the seal 7 of the cup in the process of being removed.

The teat 10 has a dome shaped base 12 and a spout or nipple 13 on that base. The teat 10 mimics a breast. In FIGS. 1-3 the teat 10 is received in the mounting ring 11. In FIGS. 2 and 3 the mounting ring 11 releasable mounts the teat 10 onto the cup holder 9 and clamps the cup 3 in the cup holder 9 at the same time.

According to the invention, the feeding bottle 2 is provided with a water fill opening 14, which water fill opening is provided in the cup holder and/or in the mounting ring and/or in the base of the teat, through which fill opening the feeding bottle can be filled with water while the opened cup is held by the cup holder and the teat is mounted on the cup holder. In the particular embodiment shown, the water fill opening 14 is provided in the mounting ring 11 and the base 12 of the teat 10. This will be explained in more detail further on.

The feeding bottle 2 is furthermore provided with a closure device 15 adapted to seal the water fill opening. In the particular embodiment shown, the closure device 15 is provided in the form of a plug, which plug is shown inserted in the water fill opening 14 in FIGS. 1 and 2.

Figure 9:
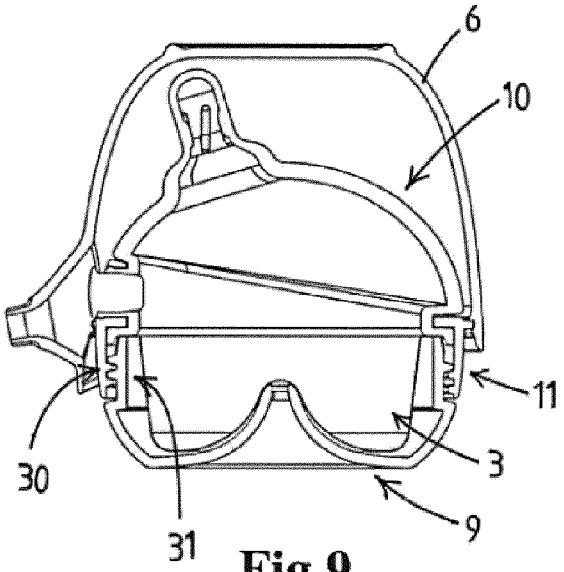
FIG. 9 shows a side view in cross section of the feeding bottle and beaker of FIG. 8.

FIG. 3 shows the feeding bottle 2 with the closing device 15 removed from the water fill opening 14, and the beaker 6 engaging the water fill opening to fill the feeding bottle, more in particular a mixing cavity 16 of the feeding bottle, with water to be mixed with the single serve of infant formula 8. FIGS. 7 and 9 show a cross section of the feeding bottle 2 according to the invention, in which the mixing cavity 16 is shown.

According to the invention, the mixing cavity 16 is at least partially defined by the teat and the cup. In the particular embodiment shown, the teat 10, when mounted on the cup holder 9, directly engages the cup 3, and the mixing cavity 16 is thus in full defined by the teat and the cup.

Once the mixing cavity 16 has been filled with the correct volume of water, the beaker 6 is removed from the water fill opening 14 which is subsequently closed with the plug 15. The single serve of infant formula 8 can subsequently be mixed with the water by shaking the feeding bottle 2. After which the feeding bottle is ready for feeding an infant.

Figure 4:
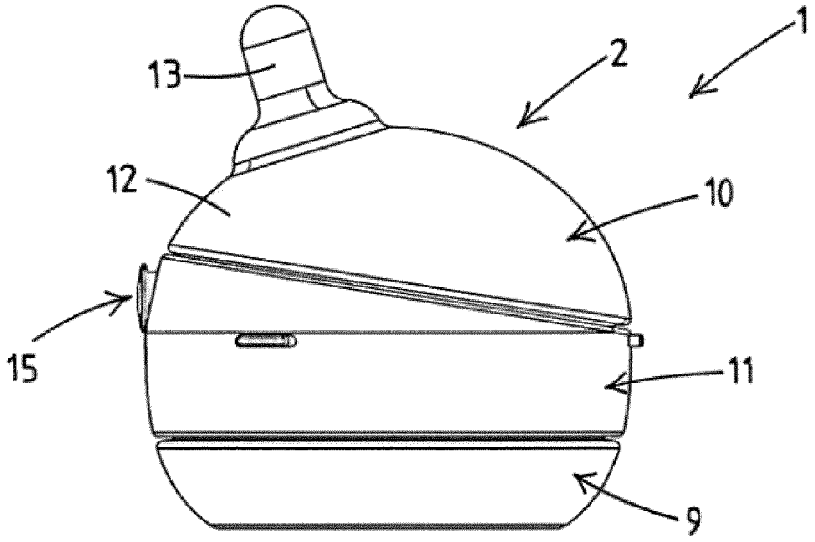
FIG. 4 shows a side view of a feeding bottle of the feeding assembly of FIG. 1.
Figure 5:
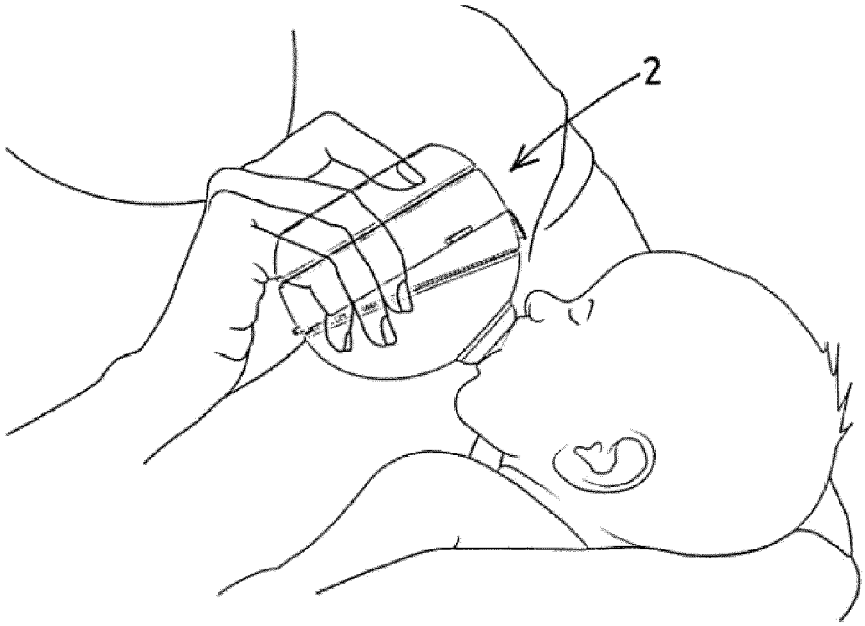
FIG. 5 shows a side view of the feeding bottle of FIG. 1 being used for feeding an infant.

FIG. 4 shows a side view of a feeding bottle 2 of the feeding assembly 1 of FIG. 1 in its assembled state, i.e. holding the opened cup 3. FIG. 5 shows a side view of the feeding bottle 2 of FIG. 4 being used for feeding an infant.

Figure 6:
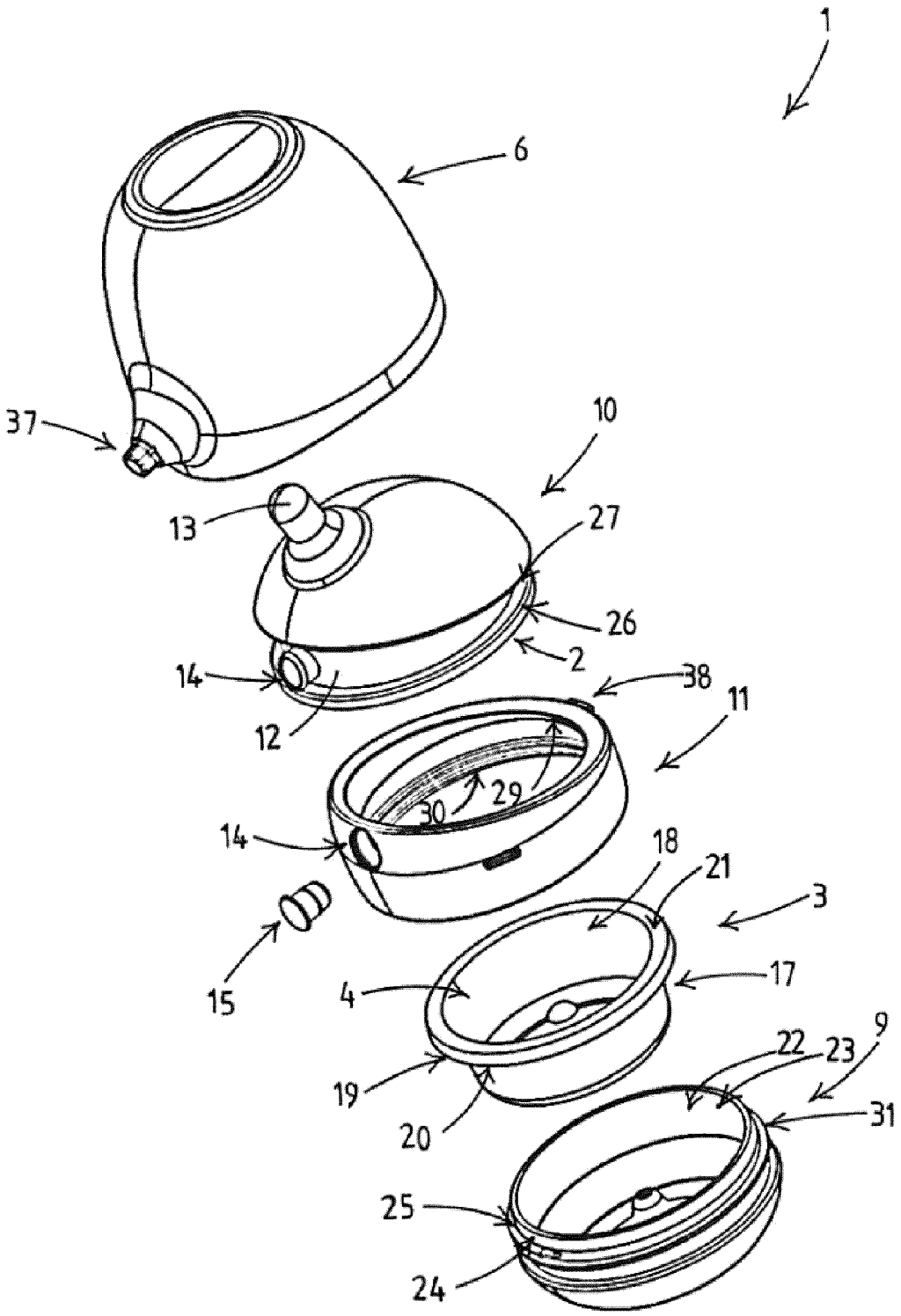
FIG. 6 shows an exploded view of the feeding assembly of FIG. 1 in combination with a beaker.

FIG. 6 shows an exploded view of the feeding assembly 1 of FIG. 1 in combination with the beaker 6, and thus shows more details the different components of the infant feeding assembly. In the exploded view the cup 3 is depicted with its seal 7 removed and without the single serve of infant formula 8 to be mixed with water, The cup 3 of the particular embodiment shown has a cup section 17 that defines the cavity 4 for holding the infant formula. The cup 3 has a dispensing opening 18 that provides an entrance to the cavity 4, and has a flange 19 that extends along the dispensing opening.

The flange 19 of the cup having a bottom side that provides an annular shaped support surface 20 and a topside that provides a planar and annular shaped sealing surface 21. When the cup is sealed, the seal 7 is attached to sealing surface 21 of the flange 19 of the cup such that the seal seals off the dispensing opening. Thus, the infant formula in the cavity is shielded from the environment and from contamination.

The seal 7 is a tear of seal which is attached to the sealing surface of the flange of the cup, and is configured to be at least partially torn away from the cup to open up the cavity of the cup to make the infant formula available to be mixed with water. In the embodiment shown, the seal 7 is provided with a lip section which provides a grip surface for a user to engage the seal and thus facilitate tearing the seal from the cup holder. In an alternative embodiment, the seal can be provided with multiple grip surfaces or with a single grip surface extending along the entire periphery of the cup. Alternative configurations for enabling a seal to be removed from a cup known from the prior art may also be implemented with a seal of a cup according to the invention.

The cup holder 9 of the feeding bottle 2 is adapted to hold the cup 3 in its opened condition, i.e. with its seal removed or broken. The cup holder has a cavity 22 for receiving the cup section 17 of the cup 3, a receiving opening 23 that provides an entrance to the cavity 22 of the cup holder, and a rim 24 that extends along the receiving opening 23. The rim 24 of the cup holder 9 provides an annular support surface 25 for supporting the flange 19 of the cup 3 when the cup is received in the cavity 22 of the cup holder.

The teat 10 of the feeding bottle 2 has the dome shaped base 12 and a nipple 13 on that base. With its spherical shaped base 12, which is large compared to the size of the nipple 13, the teat 10 mimics a breast, which effect is enhanced by the nipple being placed off center, i.e. not on the top of the base 12. In the particular embodiment shown, the base 12 is provided with a flange 26, the flange of the teat having a top side that provides a planar and annular shaped support surface 27 and a bottom side that provides a planar and annular shaped sealing surface 28 that engages the sealing surface 21 of the cup 3 when the opened cup is held by the cup holder and the teat 10 is mounted on the cup holder by way of the mounting ring 11, i.e. in the assembled state of the feeding bottle 2.

The mounting ring 11 of the feeding bottle 2 is adapted to releasable mount the teat 10 onto the cup holder 9. The mounting ring 11 has a planar and annular shaped clamping surface 29 that engages the support surface 27 of the teat 10, such that, when the opened cup 3 is held by the cup holder 9, the flange 26 of the teat 10 is located on the flange 19 of the cup 3, and both the flange 26 of the teat 10 and the flange 19 of the cup 3 are located between the rim 24 of the cup holder 9 and the clamping surface 29 of the mounting ring 11.

The mounting ring 11 is provided with a releasable coupling device for coupling the mounting ring with the cup holder 9 such that the mounting ring clamps the flange 26 of the teat 10 onto the flange 19 of the cup 3 to provide a seal. In the particular embodiment shown, the mounting ring 11 is provided with a releasable coupling device in the form of screw thread 30 that is provided on the inside of the mounting ring for cooperating with screw thread 31 provided on the outside surface of the cup holder 9.

According to the invention, the feeding bottle 2 is provided with a water fill opening 14, which water fill opening in the particular embodiment shown is provided in the mounting ring 11 and in the base 12 of the teat 10. Through the water fill opening 14 the feeding bottle 2 can be filled with water while the opened cup 3 is received in the cup holder 9 and the teat 10 is mounted on the cup holder 9. In the embodiment shown, the teat 10 is furthermore configured such that a section of the teat forms a liner 32 along the inside surface of the water fill opening provided in the mounting ring. Thus the pliant material the teat is made of is used to provide a sealable opening, without the need of providing additional sealing elements such as sealing rings that need to be mounted in the water fill opening during manufacturing and/or assembly of the feeding bottle and/or its components.

The closure device 15 adapted to seal said water fill opening 14 comprises a plug configured for cooperating with the pliant liner of the water fill opening. By inserting the plug 15 into the water fill opening 14 the water fill opening is closed, which allows for mixing the infant formula with the water filled into the feeding bottle by shaking the closed feeding bottle.

In use, the feeding bottle shown can be disassembled into its separate components to facilitate sterilizing the components in ways known in the prior art.

Preparing a feeding bottle for feeding an infant using the feeding assembly according to the invention involves the following steps:

- providing the sealed cup 3, the cup holding a single serve of infant formula 8;
- providing the feeding bottle 2, the feeding bottle comprising the cup holder 9 for holding the cup 3, the teat 10, the mounting ring 11 for mounting the teat onto the cup holder, and the plug 15 for sealing the water fill opening 14, which water fill opening is provided in the mounting ring and in the teat;
- removing the seal 7 of the cup 3 and placing the cup in the cup holder 9;
- mounting the teat 10 onto the cup holder 9 using the mounting ring 11, using the teat 10 to clamp the cup 3 in the cup holder, the sealing surface 28 flange 26 of the teat 10 directly engaging the sealing surface 21 of the flange 19 of the cup 3 such that the teat and the cup together define a mixing cavity for holding the infant formula and the water for mixing with the infant formula;

filling the feeding bottle 2 via the water fill opening 14 and closing the water fill opening with the closing device 15 after the feeding bottle has been filled with the correct volume of water; and mixing the single serve of infant formula 8, with the water filled into the feeding bottle, by shaking the closed feeding bottle.

After the feeding bottle has thus been prepared, it can be held with the cup holder in the palm of the hand, the fingers extending along the cup holder, the mounting ring for providing grip. Thus, the feeding bottle enables mimicking a teat during the feeding process not only in shape but also in feeding experience for the infant, as is clear from FIG. 5.

It is noted that the functional surfaces, i.e. the clamping surfaces, support surfaces, sealing surfaces, etc., of the cup holder, the teat and the mounting ring can also be achieved with embodiments that differ from those shown in the figure. Embodiments that differ from the ones shown, but are provided with similar functional surfaces for the same purpose as disclosed are considered to fall within the scope of the claims of the invention.

It is submitted that the mounting ring, the teat and the cup holder shown are exemplary embodiments of a components of a feeding bottle of a feeding assembly according to the invention only. Different embodiment are also possible within the scope of the invention, for example, the mounting ring and/or the cup holder may comprises multiple components which are combined to form the mounting ring and cup holder for the feeding bottle in its assembled condition. For example, the mounting ring may comprise two ring elements which are to be screwed together or clamped together using click finger, to form the mounting ring and secure the teat in the clamping ring by clamping a section of the teat between them.

Preferably, the cup holder, the mounting ring and the teat are each single integral components that need to only need to be combined with each other to form the feeding bottle. Thus, the assembly process can be kept efficient.

In an embodiment, the teat and the mounting ring may be combined into a single component during the manufacturing process, for example by two component injection molding.

The mounting ring, the cup holder, and the teat are preferably made using the injection molding technique, for example by injection molding a PP material. The teat is preferably made of a pliant material which is easy to sterilize, for example a silicone material.

In an embodiment, for example the teat is provided with base and nipple made out of a silicone material and for example a flange along the bottom area of the base made out of another, less pliable material, which flange for example provided with screw thread, for securing the teat in the mounting ring, wherein the base and flange are merged into a single integral component during the fabrication process, for example by way of two component injection molding.

FIGS. 7*a-d* show a side view in cross section of the feeding bottle 2 of FIG. 4 in its assembled state, with the cup 3 in subsequent working positions, i.e. in subsequent positions during the feeding process. In the figures the infant formula and water are not depicted.

In the particular embodiment shown, the feeding assembly 1 has a cup 3 with a cup section 17 that has a flexibility that enables, when the opened cup 3 is mounted in the feeding bottle 2, the cup section 17 to collapse inwards, i.e. to billow towards the dispensing opening 18 of the cup, and to billow through said dispensing opening up and into the teat 10. This transformation of the cup during the feeding process balances out an underpressure created inside the feeding bottle caused by an infant drinking from the feeding bottle.

When the full cup section can billow through the dispensing opening of the cup, the cup section is moved from the bottom side of the flange of the cup to the sealing side of the flange of the cup, the cup section turning inside out during this process. Thus, the inside surface of the cup section faces outwards when the cup section is fully collapsed, i.e. in its fully billowed condition inside the teat. Thus, the flexibility of such a cup is optimally used for preventing underpressure, or vacuum, in the mixing cavity during the feeding process.

Furthermore, in the particular embodiment shown, the cup is not only configured such that the full cup section can billow through the dispensing opening of the cup, in addition, the cup section 17 of the cup 3 is also dimensioned such that the cup section in its fully billowed condition lies along the inner surface of the teat 10. This condition is shown in FIGS. 7*c* and 7*d*. FIG. 7*a* shows the cup in its original condition, and FIG. 7*b* shows the cup in an intermediate position, while billowing through the dispensing opening 18 of the cup 3.

When the cup is in its fully billowed condition, shown in FIGS. 7*c* and 7*d*, there is only a little space left between the teat 10 and the cup 3. Thus, the mixing cavity 16 is essentially cancelled out by the billowed cup 17 section. It is noted that in the embodiment shown the feeding bottle 2 is furthermore configured such that the teat 10 and cup together define the mixing cavity 16, i.e. in the assembled state of the feeding bottle the teat engages the flange section of the cup. Therefore, as is clearly shown in the figures, to achieve the above mentioned effect, the inner volume of the teat is substantially similar to the volume of the cup section of the cup.

Furthermore, in the embodiment shown, the teat is provided with a flexibility that enables the teat to collapse during the feeding process to counterbalance a vacuum in the mixing cavity. The flexibility of the teat and the flexibility of the cup are such that during the feeding process the cup collapses first, which is shown in FIGS. 7 *b* and 7*c*, and the teat only collapses after the cup is in its fully collapsed position, which is shown in FIG. 7*d*. Therefore the teat does only to a small extend collapses during the feeding process, and, in the embodiment shown, the teat only collapses at the end of the feeding process, when the last of the instant formula mixed with water is sucked out of the mixing chamber. Thus, the teat maintains its breast like shape during the feeding process, while its flexibility is utilized at the end of the feeding process to enable the feeding bottle to be emptied without a significant underpressure is the mixing cavity.

In the embodiment shown, the flange of the cup 3 is provided with a rim 5. The rim 5 is provided at the outer end of the flange 19 of the cup and extends at an angle with the flange 19, in particular with the support surface 20 of the flange of the cup, in the downward direction, i.e. towards the bottom of the cup. When the cup 3 is positioned in the cup holder 9, the flange 19 of the cup rests on the support surface of the cup holder 25 and the rim 5 is located beyond the support surface, such that it falls over the rim of the cup holder and thus hooks behind it. See FIGS. 6 and 7*a-d*.

The rim provides the flange of the cup with additional rigidity, which is beneficial when the user tears of the seal to open the cup. Furthermore, in the particular embodiment shown, the rim is used to further secure the cup in its position in the cup holder. Thus, the cup holder can be used to provide the cup with additional support to facilitate removing the seal from the cup.

For example, with the embodiment shown the sealed cup can be placed in the cup holder first, after which the seal is torn from the cup holder, see FIGS. 1 and 2. It is noted that in the embodiment shown, the rim is exposed when the cup is located in the cup holder, providing a grip surface that can be engaged by the user when holding the cup holder, to further secure the cup in its position in the cup holder while tearing off the seal. In a further embodiment, the size of the rim can be extended to provide a larger grip surface to be engaged by the user when holding the cup.

In an alternative embodiment, the cup holder is provided with a recess located in or adjacent the support surface of the cup holder for receiving the rim of the cup to thus secure the cup in its position in the cup holder.

Preferably the rim of the cup extends at a substantially right angle with the support surface of the cup, i.e. with the flange of the cup, to optimally secure the cup, in particular the flange of the cup, against movement in a direction parallel to its support surface, for example when the seal is torn form the cup or when the cup is transformed during the feeding process. For example, in an embodiment, the cup holder is provided with a support surface for supporting the flange of the cup, in which support surface a recess is provided for receiving the rim provided on the flange of the cup. Thus, when the cup is positioned in the cup holder.

In another alternative embodiment, the cup holder is provided with additional securing means, for example a securing ring, clamps or click fingers, for securing the sealed cup in the cup holder, and thus provide a support for the cup to facilitate tearing off the seal by the user.

In the particular embodiment shown, the cup section 17 of the cup 3 is provided with a convex shaped central bottom section 33, of which the apex 34 is directed towards the dispensing opening 18 of the cup, to further facilitate the billowing of the cup during feeding. It has been found that providing the cup, more in particular the cup section of the cup, with a convex shaped central bottom section propagates billowing of through the dispensing opening. In the particular embodiment shown, the convex shaped central bottom section is curved, such that there is a smooth transition between the convex shaped central bottom section and the surrounding cup section of the cup. The curved shape enables a gradual and smooth transformation of the cup. This is in particular the case since the cup section, in a plane parallel to support surface, has a circular shaped cross section, more in particular when the convex shaped central bottom section has a circular cross section.

In an alternative embodiment, the form of the convex shaped bottom section may differ, for example be more conical in shape, or more triangular, e.g. have a pyramid shape, or have a cylindrical shape, etc. Also, the convex shaped central bottom section may be provided with additional recesses e.g. have a corrugated surface.

In the particular embodiment shown, the cup holder 9 is provided with a bottom section 35. The bottom section 35 of the cup holder 9 shields the cup 3, more in particular the cup section 17 of the cup, when the feeding bottle 2 is in its assembled state.

In the embodiment shown, the bottom section 35 of the cup holder 9 is spherical shaped along its periphery such that it enhances the fit of the feeding bottle 2 in the palm of the hand, see for example FIG. 5. Furthermore, at its center the bottom section 35 has a raised bottom section 36, such that the feeding bottle 2 can stand on a flat support surface, such as a table top, see for example FIG. 4. By providing the cup holder 9 with such a bottom section the cup 3, in particular the cup section of the cup 17, is shielded during use of the feeding bottle.

Furthermore, in the embodiment shown, the raised central section 36 of the bottom part 35 of the cup holder 9 is configured to support the central part of the convex shaped central bottom section 33 of the cup 3 received in the cup holder, see FIG. 7*a*. By thus supporting the bottom of the cup 3, the cup holder 9 prevents the convex shaped bottom section 33 from billowing outward, i.e. away from the dispensing opening 18 of the cup 3. This is especially beneficial when the cup is highly flexible, and for example after removal of the seal has the tendency to bulge outward when the feeding bottle is filled with water and/or during the mixing process, especially when the mixing is achieved by shaking the feeding bottle. Furthermore, substantial transformation of the cup during the filling process may complicate filling the mixing cavity with the correct amount of water. This is especially the case when the teat is provided with markings to indicate the volume of water present in the mixing cavity.

Furthermore, in the embodiment shown, the raised central bottom section 36 of the cup holder 9 has a convex shape, configured to substantially fit the convex shaped bottom section 33 of the cup 3 received in the cup holder. Thus providing the cup with optimal support which allows for using a highly flexible cup with the feeding bottle, which cup is provided with a convex shaped bottom section that propagates billowing of the cup through the dispensing opening of the cup during the feeding process. Such a cup may for example, after removal of the seal, have the tendency to bulge outward when the feeding bottle is filled with water and/or during the mixing process, especially when the mixing is achieved by shaking the feeding bottle. It is noted that the convex shaped bottom section is extra prone to bulging outward, for example during the mixing process.

In the embodiment shown, the bottom section 35 of the cup holder 3, in particular the raised bottom section 36, of the cup holder is provided with a central openings to allow outside air to flow into the cup holder during the inwards collapse, i.e. and thus enable the cup to billow towards and through the dispensing opening of the cup. It is noted that by providing the opening at the center of a convex shaped bottom section, the chance of the opening accidentally being covered by a hand during the feeding process, which may obstruct the billowing of the cup during the feeding process, is nil. In an alternative embodiment, the opening and/or additional openings can be provided in the walls and/or the bottom section of the cup holder to thus minimize the chance of the opening(s) being covered during the feeding process. Also, the openings can be larger than the one shown, in a further embodiment, the walls of the cup holder can be provided with a mesh structure, which in addition may also enhance a user holding the cup holder with additional grip. Alternative embodiments are also possible within the scope of the invention.

Figure 8:
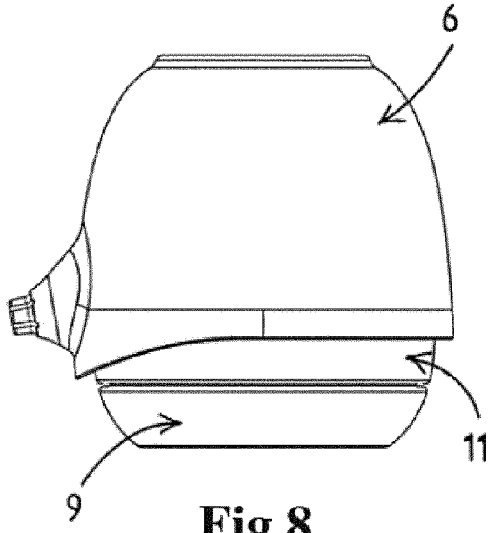
FIG. 8 shows a side view of the feeding bottle of FIG. 4 in its assembled state, with the beaker mounted on the feeding bottle.

FIG. 8 shows a side view of the feeding bottle of FIG. 4 in its assembled state, with the beaker mounted on the feeding bottle, and FIG. 9 shows a side view in cross section of the feeding bottle and beaker.

The feeding assembly shown is provided with a beaker 6, which beaker is configured for filling the feeding bottle 2 with water via the water fill opening 14, see FIG. 3. Therefore, the beaker 6 is provided with a spout 37 for cooperating with the water fill opening 14 of the feeding bottle 2. The spout is shaped such that it substantially fits the water fill opening. The resilient liner 32 of the water fill opening provides for a leak free coupling of spout and water fill opening. Thus, the beaker can be used for filling the feeding bottle, when in its assembled stated, holding the opened cup, with the volume of water to be mixed with the single serve instant formula held in the cup.

In an alternative embodiment, the water fill opening and/or the spout of the beaker is/are provided with an alternative sealing device, for example a rubber sealing ring mounted on the outside of the spout or in the inside of the water fill opening, to provide a water tight coupling between the beaker and the feeding bottle, more in particular the mixing cavity of the feeding bottle.

In the particular embodiment shown, the beaker 6 is provided with a spout 37 that has the shape of closed conduit, the conduit extending between an inlet opening and an outlet opening. The outlet opening of the conduit is provided at the top of the beaker, providing the beaker with a configuration roughly similar to a teapot or watering can. Thus, the beaker is configured for being tilted over an angle, for example over an angle of about eighty degrees, when filling the feeding bottle, see FIG. 3. This allows for filling the feeding bottle while it is held in a position with the water fill opening facing upwards, and is especially beneficial when the spout of the beaker is configured to be coupled with the water fill opening.

In the embodiment shown, the beaker is adapted to be secured on the feeding bottle in a storage position. Furthermore, the beaker is dimensioned such that it covers the teat when the beaker is mounted on the feeding bottle in its storage position, which is shown in FIGS. 8 and 9. A fastening device is provided, in the particular embodiment shown in the form of click fingers on the outside of the mounting ring that cooperate with a ring shaped rim on the inside of the beaker, to releasable secure the beaker on the feeding bottle in its storage position. It is noted that alternative fasting devices, such as screw thread, can also be used.

Figure 10:
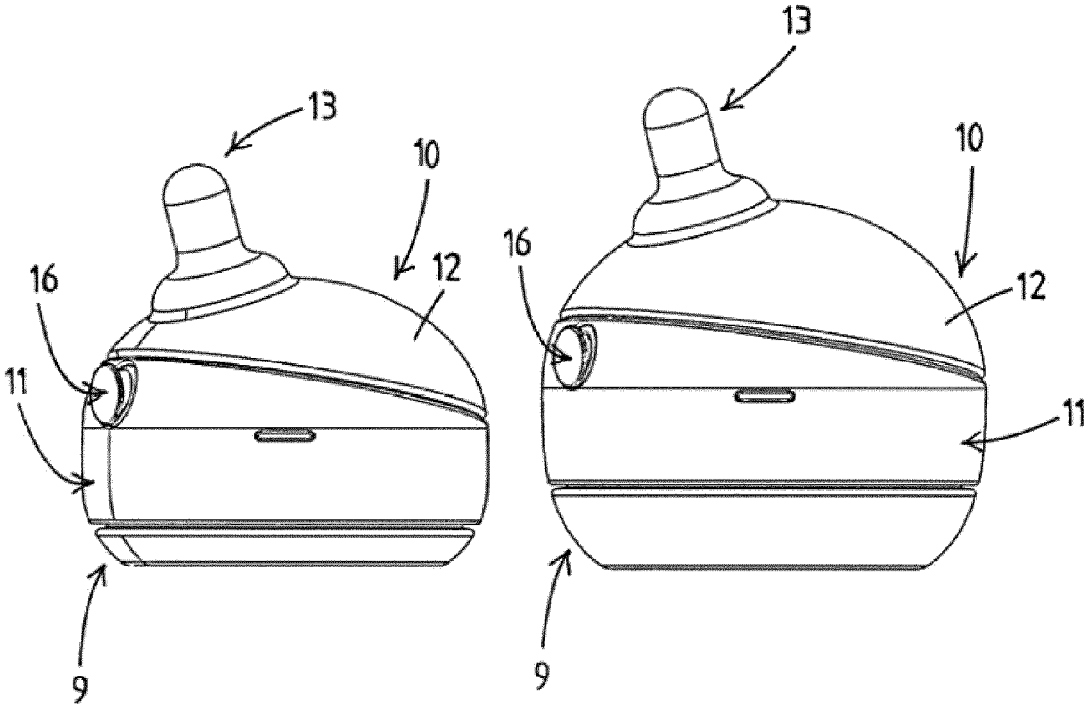
FIG. 10 shows a side view of the feeding assembly of FIG. 1 and an alternative feeding assembly.

FIG. 10 shows a side view of the feeding assembly 2 of FIG. 1 and an alternative feeding assembly 2'. Similar components of the feeding bottles have been provided with the same reference signs. The alternative feeding assembly differs in the size of the components, in particular of the cup holder 9'. Thus, the alternative feeding assembly can be used with larger cups, holding larger quantities of infant formula, and has a mixing cavity that can be filled with a larger volume of water. For example one feeding assembly is configured for use with cups holding 35 or 100 ml infant formula, and the other for uses with cups for holding 165 or 200 ml infant powder. In such a feeding assembly, each feeding bottle can be used with one size cup, which cup is configured to be filled with the small amount or the full amount of infant formula. Alternatively, both feeding bottles can each be combined with a cup having a small sized cup section for holding the small amount of infant formula and with a cup having a large sized cup section for holding the large amount of infant formula. The cup sections may differ in size by providing the cup sections with a central raised bottom section, for example a conical or spherical shaped raised central bottom sections, as explained here above, which raised bottom sections differ in size. Thus, each feeding bottle can be used with cups that differ in the size of the cavity holding the infant formula, while the overall dimensions of the cup, i.e. the size flange, and the height and width of the cup sections are the same.

It is noted that in a further alternative embodiment, for example only one or two components of the feeding bottle differ in size. For example, by providing two types of cup holders, one small sized and one large sized, a feeding assembly can be adapted to be used with larger or smaller sized cups by changing the cup holders. When the cup holders differing in height only and not in cross section, they can both be used with the same mounting ring and teat. Thus, only one extra component needs to be provided to provide different sized feeding assemblies.

In an embodiment of a feeding assembly according to the invention the cup is a flexible cup, configured to billow towards and optionally through the dispensing opening of the cup during the feeding process, and the teat is provided with a valve configured to allow air into the mixing chamber during the feeding process. Providing such a valve is for example advantageous when the feeding assembly is used with a cup that is dimensioned such that when it is in its fully billowed state, it walls are not closely adjacent the inside surface of the teat. Thus, the cup does not cancel the full mixing cavity when in its fully billowed state.

When the last volume of infant formula mixed with water is drunk from the teat, the valve allows air to enter the mixing cavity to replace the infant formula mixed with water.

From the foregoing, it will be clear to the skilled person, that within the framework of the invention as set forth in the claims also many variations other than the examples described above are conceivable. For example, FIGS. 11 and 12 each show a highly schematic exploded view in cross section of two alternative feeding bottles for use in a feeding assembly according to the invention.

Figure 11:
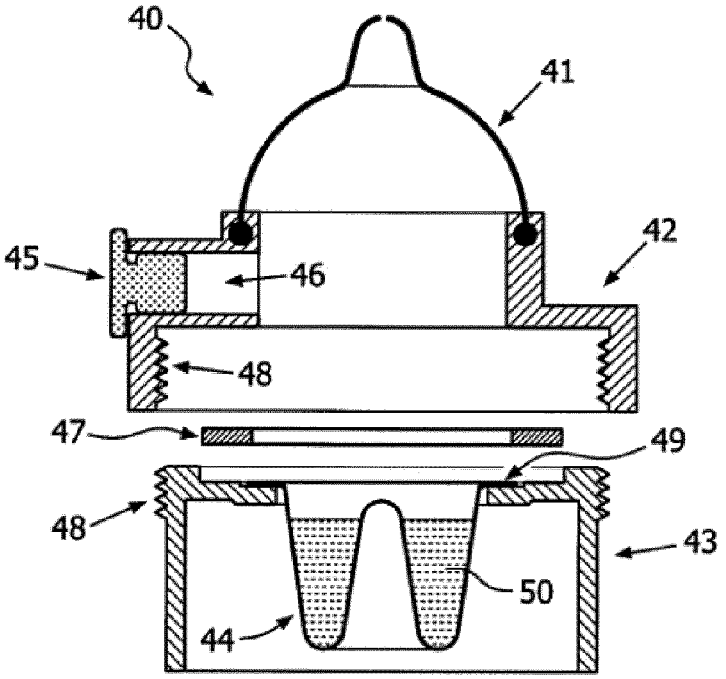
FIG. 11 shows a highly schematic cross sectional side view of a first alternative feeding bottle for use in a feeding assembly according to the invention.

The feeding bottle 40 shown in FIG. 11 comprises a teat 41, a mounting ring 42, a cup holder 43, a cup 44, a sealing device 45 for sealing a water fill opening 46, and a sealing ring 47. In this embodiment, the teat 41 is secured in the mounting ring 42, for example by injection moulding the mounting ring around a bottom rim of the teat, such that the teat and the mounting ring form a single component. The mounting ring 42 is provided with screw thread 48 on its inside, for mounting the mounting ring, and thus the teat, onto the cup holder 43, which is provided with screw thread on its outside surface. In the embodiment shown, the water fill opening 46 is provided in the mounting ring 42. A plug shaped sealing device 45 is secured in the water fill opening to seal it. Both the plug shaped sealing device 45 and the water fill opening 46 are provided with screw thread (not shown) for securing the plug in the water fill opening. Furthermore, a sealing device in the form of a sealing ring 47 is provided, which in the assembled state is clamped between the cup 44, more in particular the flange 49 of the cup, and the mounting ring 42 to provide a leak free sealing between mounting ring and cup. In this embodiment the mixing chamber is thus defined by the teat, the cup and the mounting ring.

The cup 44 holds infant formula 50, and is held in the cup holder 43, and is in the assembled state fixed in this position by the mounting ring 42 clamping the sealing ring 47 onto the cup holder and the flange of the cup. In the particular embodiment shown, the cup 44 is provided with a raised central bottom section, more in particular a convex, substantially conical shaped central bottom section, to propagate billowing of the cup into the teat during the feeding process. It is noted that the components are not drawn to scale, and that the cup is dimensioned such that, when fully billowed through the dispensing opening of the cup, the walls of the cup are located closely adjacent the inside surface of the mounting ring and the teat, such that the cup in its billowed state cancels the mixing cavity and allows for an infant to drink the mixed infant formula from the feeding bottle without creating a vacuum in the mixing cavity.

Figure 12:
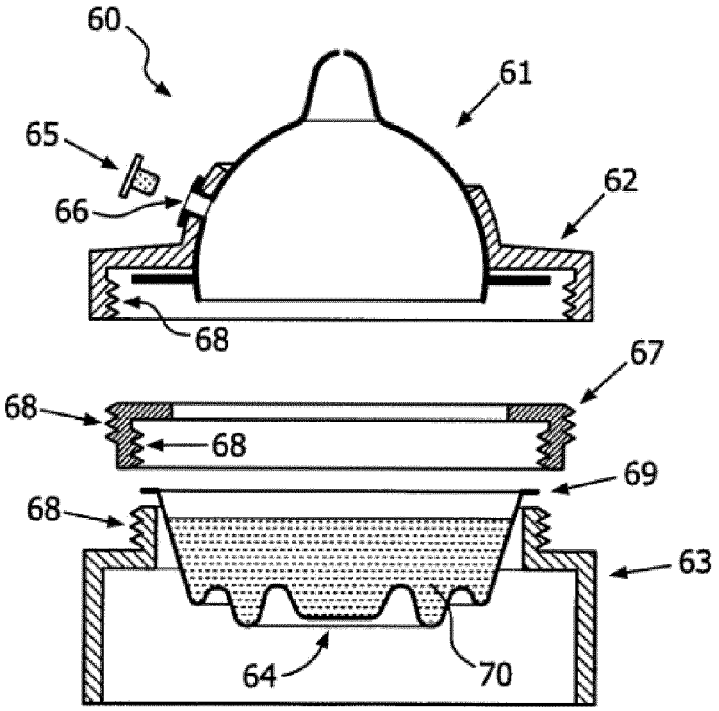
FIG. 12 shows a highly schematic cross sectional side view of a second alternative feeding bottle for use in a feeding assembly according to the invention.

The feeding bottle 60 shown in FIG. 12 comprises a teat 61, a mounting ring 62, a cup holder 63, a cup 64, a sealing device 65 for sealing a water fill opening 66, and a clamping ring 67. In this embodiment, the clamping ring 67 is provided for securing the cup 64 in the cup holder 63 prior to mounting the teat 61 on the cup holder 63 using the mounting ring 62. Thus, the cup 64 can be secured in the cup holder to facilitate tearing the seal from the cup, which is especially beneficial when the cup is a highly flexible cup with low structural rigidity.

The teat 61 is shaped such that it fits in the mounting ring 62, providing the water fill opening 66 with a resilient liner for providing a leak free sealing of the water fill opening. When the teat has been fit in the mounting ring, both can be handled as if they are a single component. The teat can however be removed from the mounting, for example to facilitate sterilization of the mounting ring and teat. It is noted that the water fill opening allows for filling the feeding bottle with water while the teat is mounted on the cup holder, i.e. when the feeding bottle is in its assembled state.

In the embodiment shown, the mounting ring is provided with inside screw thread 68 for mounting the mounting 62 ring on the clamping ring 67, the latter being mounted on the cup holder 63 with inside screw thread 68. In this embodiment, the clamping ring 67 thus forms an intermediate for mounting the mounting ring on the cup holder, and as such can be considered part of the cup holder. It is noted that this embodiment, in the assembled state of the feeding bottle, the teat is clamped on the cup holder and the flange of the cup held in the cup holder. Thus, the mixing chamber is defined by the teat and the cup.

The cup 64 holds infant formula 70, and is held in the cup holder 63, and is in the assembled state fixed in this position by the clamping ring 67. In the particular embodiment shown, the cup 64 is provided with a corrugated bottom section to propagate billowing of the cup into the teat during the feeding process. It is noted that the components are not drawn to scale, and that the cup is dimensioned such that, when fully billowed through the dispensing opening of the cup, the walls of the cup are located closely adjacent the inside surface of the mounting ring and the teat, such that the cup in its billowed state cancels the mixing cavity and allows for an infant to drink the mixed infant formula from the feeding bottle without creating a vacuum in the mixing cavity.

Figure 13:
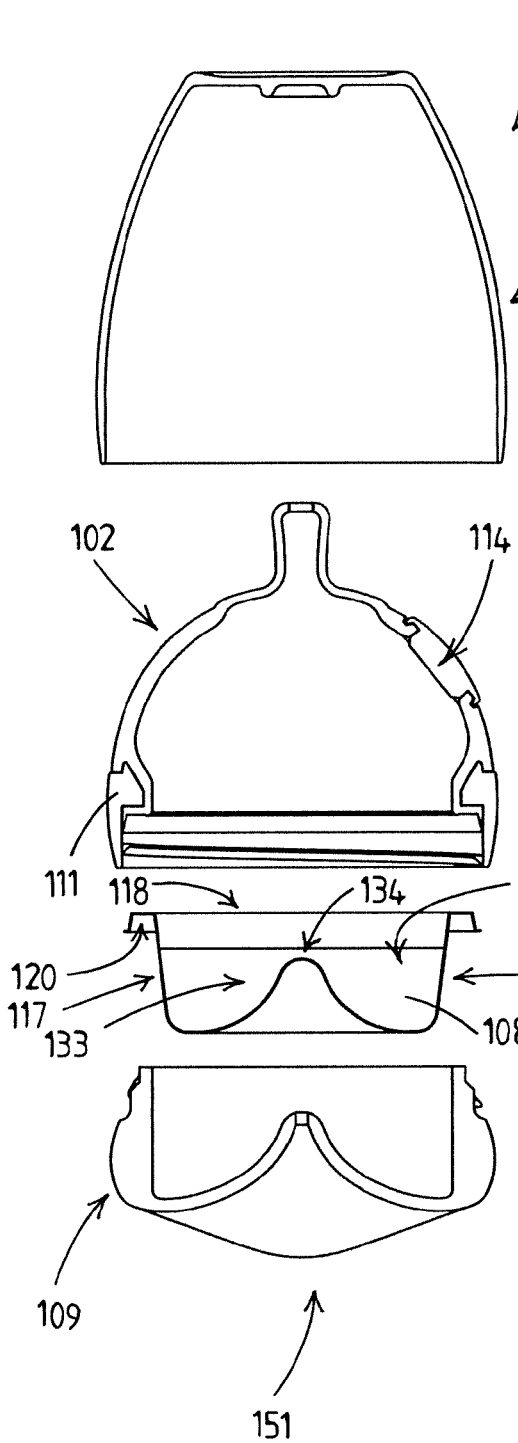
FIG. 13 shows an exploded view in cross section of an alternative embodiment of a feeding assembly according to the invention.
Figure 14:
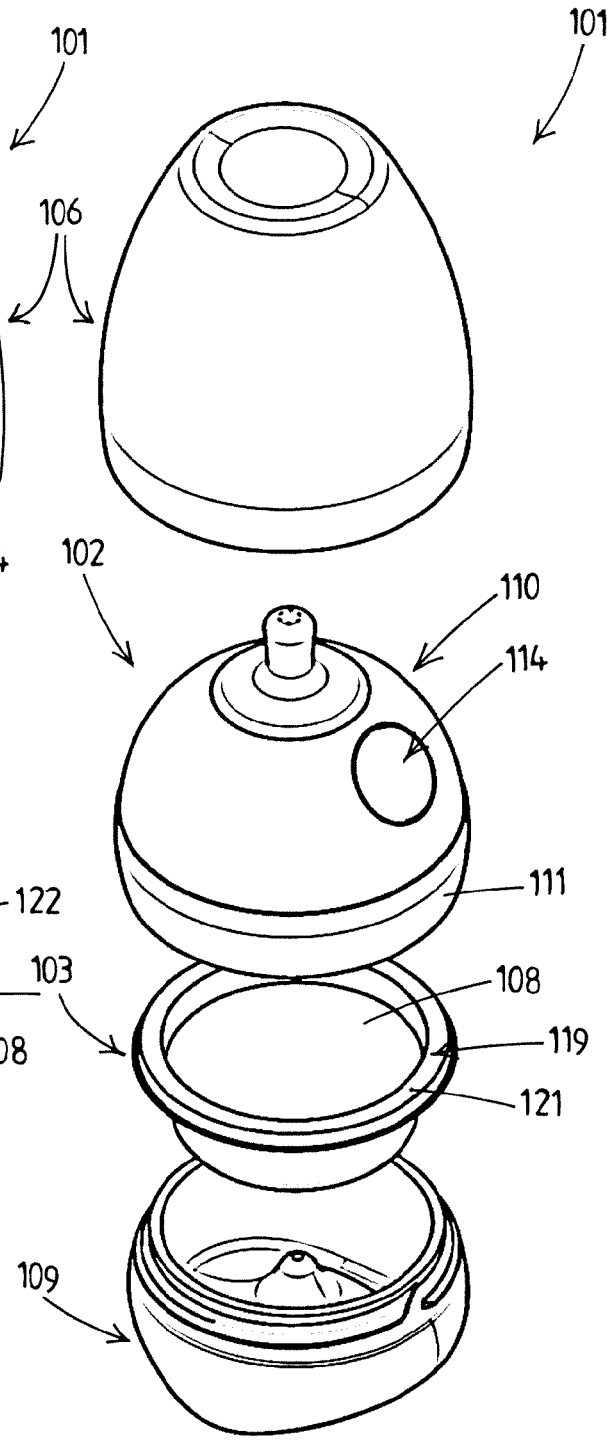
FIG. 14 shows a perspective view of the exploded view of FIG. 13.

FIG. 13 shows an exploded view in cross section of an alternative embodiment of a feeding assembly 101 according to the invention and FIG. 14 shows a perspective view of the exploded view of FIG. 13. In the embodiment shown, the feeding assembly 101 comprises a feeding bottle 102, a cup 103 and a protective cover 106. The cup 103 is depicted with its seal removed.

The protective cover 106 is configured to seal the openings in the spout when mounted on the feeding bottle, which is clear from the exploded view shown in FIG. 13, to thus prevent leakage from the spout.

The cup holder 109 of the feeding bottle 101 is provided with a foot section 151, which foot section is configured such that when the cup holder is placed on a substantially horizontal support surface in a first and in a second position.

Figure 15:
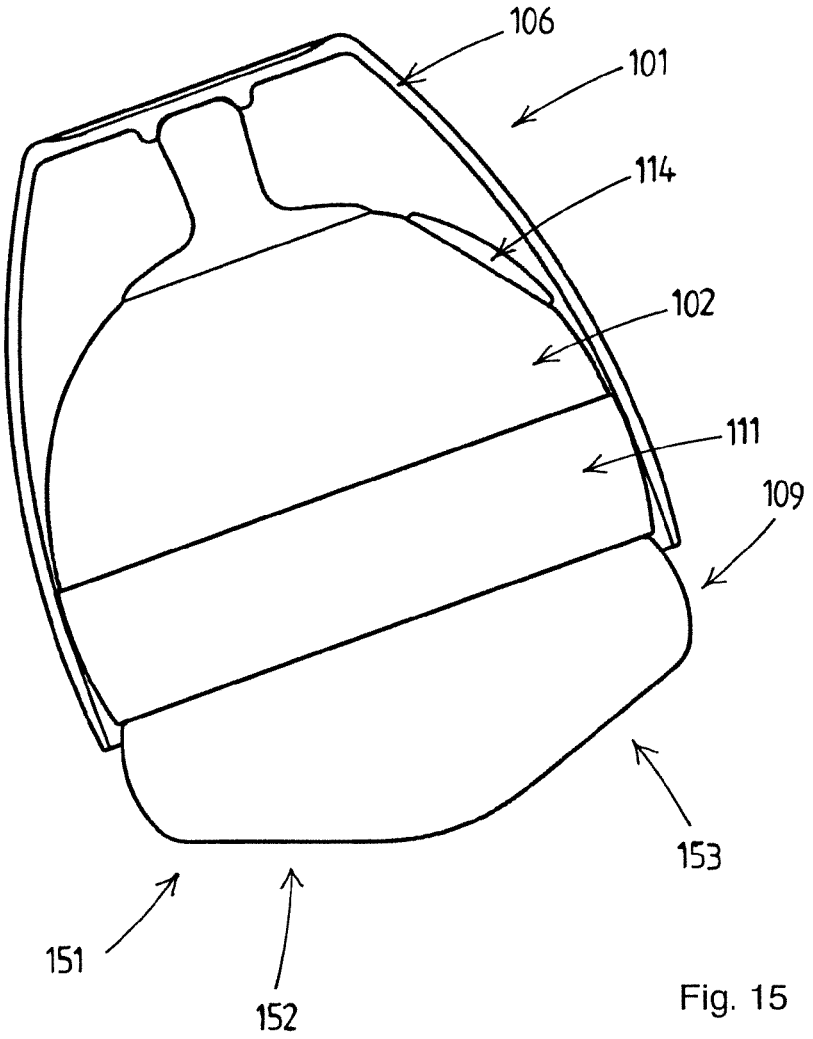
FIG. 15 shows a side view of the feeding assembly of FIG. 13 in a first resting position.

To achieve this, the cup holder 109 is provided with a first flattened bottom surface 152 that positions the cup holder in a first position, and as second flattened bottom surface 153 that positions the cup holder in a second position. FIG. 15 shows the feeding bottle in a first position, with the water fill opening 114 facing upwards.

In the particular embodiment shown, the cup holder 109 and the mounting ring 111 are provided with a double screw thread. Furthermore, the water fill opening 114 is placed off center in the teat 110, i.e. is not above the center of the filling opening of the cup 103 held in the cup holder 109 (see FIG. 13). Thus, the teat 110 can be mounted on the cup holder 109 in two positions, one of which is shown in FIG. 15. In the alternative position, the water fill opening is positioned on the opposite side of the feeding bottle, i.e. mirrored in a plane of symmetry, the plane of symmetry comprising an central axis defined by the screw threads. The two flattened bottom surfaces 152,153 of the foot section 151 extend at an angle relative to each other and relative to the plane of symmetry, and thus provide the feeding bottle with two filing positions. Thus, the bottle can always be poisoned with the water fill opening facing upwards.

The cup 103, shown in cross section in FIG. 13, has a cup section 117 that defines a cavity 122 for holding the infant formula 108, a dispensing opening 118 that provides an entrance to said cavity, and a flange 119 that extends along said dispensing opening. The flange 119 of the cup has a bottom side that provides a support surface 120 and a topside that provides a sealing surface 121, for attaching a foil type seal to the cup to seal the cavity 122, the cavity holding the single serve of infant formula.

In the particular embodiment shown, the cup section 117 of the cup 103 is provided with a convex shaped central bottom section 133 to further facilitate the billowing of the cup during feeding according to the invention. The apex 134 of the raised central bottom section 133 is directed towards the dispensing opening 118 of the cup 103, to further facilitate the billowing of the cup during feeding. Thus, during the feeding process, the bottom of the cup will billow through the dispensing opening, essentially flipping the cup, more in particular the cup section of the cup, inside out. In the embodiment shown, the apex or top 134 of the raised central bottom section of the cup is located in the upper half of the cup section. Thus, the height of the raised central bottom section is at least half the depth of the cup.

In the embodiment shown in FIGS. 13-16, the teat 110 and the mounting ring 111 may be combined into a single component during the manufacturing process, for example by two component injection molding. It is noted that the more flexible material the teat 110 is made off, runs along the less flexible material of the mounting ring 111, which requires rigidity to provide effective screw thread, to form a sealing surface at the bottom side of the mounting ring, see FIG. 13. Thus, the flexible material is used to engage the top of the flange 19 of the cup, and provide a leak tight seal.

The invention claimed is:

1. An infant feeding assembly comprising:

a feeding bottle comprising:

a cup holder;

a teat configured to mimic a breast;

a mounting ring configured to releasable mount the teat onto the cup holder; and a water fill opening through which water can be received in a mixing cavity of the feeding bottle;

wherein the water fill opening is provided in the mounting ring and in a part of the teat that is held in the mounting ring.

2. The feeding assembly according to claim 1 further comprising a pre-shaped but pliable plastic cup having a sealed condition and an opened condition;

wherein the teat comprises:

a dome-shaped base defining an opening at a bottom side thereof; and a spout provided on the dome-shaped base;

wherein the feeding bottle further comprises a closure device configured to seal the water fill opening to allow for the mixing of water and infant formula in the mixing cavity by shaking the feeding bottle;

wherein the cup comprises:

a cup section that defines a sealed cavity holding infant formula to be mixed with water in the mixing cavity, the mixing cavity at least partially defined by the teat of the feeding bottle and the cup, wherein the sealed cavity has a width that is at least two times a depth of the sealed cavity;

a dispensing opening that provides an entrance to the sealed cavity; and a flange that extends along the dispensing opening and has:

a bottom side that provides a planar- and annular-shaped support surface; and a topside that provides a planar- and annular-shaped sealing surface;

wherein the cup holder is configured to hold the cup in the opened condition in an assembled state of the feeding assembly; and wherein in the assembled state of the feeding assembly, at least part of the cup section of the cup has a flexibility that enables the cup section to balance out an under-pressure created inside the feeding bottle caused by a feeding event when an infant drinks from the feeding bottle by:

billowing towards the dispensing opening of the cup; and billowing through the dispensing opening up and into the teat.

3. The feeding assembly according to claim 1, wherein the teat comprises:

a dome-shaped base defining an opening at a bottom side thereof;

a spout provided on the dome-shaped base; and a flange provided on the dome-shaped base and extending in an outward direction;

wherein the cup holder is configured to hold a cup in an assembled state of the feeding assembly; and wherein the mounting ring is provided with a flange for engaging the flange of the teat and clamping the flange of the teat onto the cup holder in the assembled state of the feeding assembly.

4. The feeding assembly according to claim 3, wherein the spout of the teat is placed off center on the dome-shaped base of the teat, such that a central axis of the water fill opening and a central axis of the spout enclose an angle smaller than 90 degrees.

5. The feeding assembly according to claim 1, wherein the feeding bottle has a substantially spherical-shaped bottom end that fits a palm of a hand.

6. The feeding assembly according to claim 1 further comprising a pre-shaped but pliable plastic cup having a sealed condition and an opened condition;

wherein the cup comprises:

a cup section that defines a sealed cavity holding infant formula to be mixed with water in the mixing cavity, the mixing cavity at least partially defined by the teat of the feeding bottle and the cup, wherein the sealed cavity has a width that is at least two times a depth of the sealed cavity;

a dispensing opening that provides an entrance to the sealed cavity; and a flange that extends along the dispensing opening and has:

a bottom side that provides a planar- and annular-shaped support surface; and a topside that provides a planar- and annular-shaped sealing surface;

wherein the cup holder is configured to hold the cup in the opened condition in an assembled state of the feeding assembly; and wherein a central axis of the water fill opening extends at an angle to a plane defined by the planar- and annular-shaped sealing surface of the flange of the cup when in the assembled state of the feeding assembly.

7. The feeding assembly according to claim 6, wherein the sealed cavity of the cup is dimensioned to hold a single serving of infant formula to be mixed with water.

8. The feeding assembly according to claim 6, wherein the flexibility of the cup section of the cup further enables the cup section to collapse inwards.

9. The feeding assembly according to claim 6, wherein the cup section of the cup is dimensioned such that the cup section in its fully billowed condition lies along an inner surface of the teat.

10. The feeding assembly according to claim 6, wherein the cup holder of the feeding bottle is provided with a bottom section, which shields the cup when in the assembled state; and wherein a bottom section of the cup holder of the feeding bottle has a raised central bottom section, which raised central bottom section of the cup holder is configured to support at least a central part of a convex-shaped central bottom section of the cup section of the cup received in the cup holder of the feeding bottle, to prevent the convex-shaped central bottom section of the cup section of the cup from billowing outward.

11. The feeding assembly according to claim 6, wherein the cup further comprises a tear off seal which is attached to the planar- and annular-shaped sealing surface of the flange of the cup; and wherein the seal is configured to be at least partially torn away from the cup to open up the sealed cavity of the cup to make the infant formula available to be mixed with water.

12. The feeding assembly according to claim 1 further comprising:

a beaker; and a fastening device;

wherein the beaker is for filling the feeding bottle with water via the water fill opening, which beaker is provided with a spout for cooperating with the water fill opening of the feeding bottle;

wherein the beaker is securable on the feeding bottle in a storage position;

wherein the beaker covers the teat when mounted in the storage position; and wherein the fastening device releasable secures the beaker in the storage position.

13. The feeding assembly according to claim 1 further comprising a pre-shaped but pliable plastic cup having a sealed condition and an opened condition;

wherein the cup holder is configured to hold the cup in the opened condition in an assembled state of the feeding assembly; and wherein the cup is a shallow bowl.

14. Feeding bottle for providing a feeding assembly according to claim 1.

15. Method for preparing a feeding bottle for feeding an infant comprising:

providing a feeding bottle comprising:

a cup holder;

a teat configured to mimic a breast;

a mounting ring configured to releasable mount the teat onto the cup holder;

a water fill opening through which water can be received in a mixing cavity of the feeding bottle, wherein the water fill opening is provided in the mounting ring and in a part of the teat that is held in the mounting ring; and a plug for sealing the water fill opening;

providing a cup having a sealed condition and an opened condition, the cup comprising a seal and a cup section that in the sealed condition of the cup defines a sealed cavity holding infant formula to, in the opened condition of the cup, be mixed with water in a mixing cavity of the feeding bottle, the mixing cavity at least partially defined by the teat of the feeding bottle and the cup;

placing the cup in the cup holder and removing the seal of the cup;

mounting the teat onto the cup holder using the mounting ring;

filling the feeding bottle via the water fill opening with a correct volume of water;

closing the water fill opening after the feeding bottle has been filled with the correct volume of water; and mixing the infant formula, with the water filled into the feeding bottle, by shaking the closed feeding bottle.

16. An infant feeding assembly comprising:

a feeding bottle comprising:

a cup holder;

a teat configured to mimic a breast and comprising a dome-shaped base defining an opening at a bottom side thereof; and a mounting ring configured to releasable mount the teat onto the cup holder; and a cup having a sealed condition and an opened condition, the cup comprising:

a cup section that in the sealed condition defines a sealed cavity holding infant formula to, in the opened condition, be mixed with water in a mixing cavity, the mixing cavity at least partially defined by the teat of the feeding bottle and the cup; and a dispensing opening that provides an entrance to the sealed cavity;

wherein the cup holder:

is configured to hold the cup in the opened condition in an assembled state of the feeding assembly; and has a raised central bottom section;

wherein the mounting ring has a central opening at the bottom side of the dome-shaped base of the teat concentric with the central opening of the mounting ring;

wherein the cup is in the form of a shallow bowl;

wherein the cup section has a raised central bottom section with an apex; and wherein in the assembled state of the feeding assembly:

the apex of the raised central bottom section of the cup section of the cup is directed to the dispensing opening of the cup to propagate billowing of the cup during a feeding event;

the raised central bottom section of the cup holder of the feeding bottle is cooperatively shaped to support at least the raised central bottom section of the cup section of the cup to prevent the raised central bottom section of the cup section of the cup from billowing outward during the feeding event; and the flexibility of the cup section of the cup further enables the cup section to collapse inwards.

* * * * *